US007044237B2

(12) United States Patent
Leuchtenberg

(10) Patent No.: US 7,044,237 B2
(45) Date of Patent: May 16, 2006

(54) DRILLING SYSTEM AND METHOD

(75) Inventor: Christian Leuchtenberg, Swansea (GB)

(73) Assignee: Impact Solutions Group Limited, Reading (GB)

( * ) Notice: Subject to any disclaimer, the term of this patent is extended or adjusted under 35 U.S.C. 154(b) by 134 days.

(21) Appl. No.: 10/261,654

(22) Filed: Oct. 2, 2002

(65) Prior Publication Data

US 2003/0079912 A1 May 1, 2003

Related U.S. Application Data

(63) Continuation-in-part of application No. 09/737,851, filed on Dec. 18, 2000, now abandoned.

(51) Int. Cl.
*E21B 44/00* (2006.01)
*E21B 47/10* (2006.01)

(52) U.S. Cl. ..... 175/48; 166/53; 175/38; 702/13; 703/10; 73/152.21

(58) Field of Classification Search ..... 73/152.05, 73/152.19, 152.21, 152.22, 152.43, 152.51, 73/152.52, 152.53, 152.01, 152.18, 152.03; 166/250.01, 250.07, 250.15, 53; 175/24, 175/25, 38, 40, 46, 48, 57, 207, 217, 218; 702/9, 11, 12, 13; 703/10
See application file for complete search history.

(56) References Cited

U.S. PATENT DOCUMENTS

| | | | | |
|---|---|---|---|---|
| 3,429,385 A | | 2/1969 | Jones et al. | |
| 3,443,643 A | | 5/1969 | Jones | |
| 3,470,971 A | | 10/1969 | Dower | |
| 3,470,972 A | | 10/1969 | Dower | |
| 3,550,696 A | | 12/1970 | Kenneday | |
| 3,552,502 A | | 1/1971 | Wilson, Sr. | |
| 3,677,353 A | | 7/1972 | Baker | |
| 4,440,239 A | * | 4/1984 | Evans | 175/5 |
| 4,527,425 A | * | 7/1985 | Stockton | 73/152.21 |
| 4,570,480 A | | 2/1986 | Fontenot et al. | |
| 4,577,689 A | | 3/1986 | Dotson | |
| 4,606,415 A | * | 8/1986 | Gray et al. | 175/24 |
| 4,733,232 A | | 3/1988 | Grosso | |
| 4,733,233 A | | 3/1988 | Grosso et al. | |
| 4,840,061 A | * | 6/1989 | Peltier | 73/152.21 |
| 4,867,254 A | | 9/1989 | Gavignet | |
| 4,878,382 A | * | 11/1989 | Jones et al. | 73/152.04 |
| 5,005,406 A | * | 4/1991 | Jasinski et al. | 73/152.19 |

(Continued)

FOREIGN PATENT DOCUMENTS

EP 0302557 A1 2/1989

(Continued)

OTHER PUBLICATIONS

IADC/SPE 39354, Drilling Conference 1998, "Trends extracted from 800 Gulf Coast blowouts during 1960-1996", Pal Skalle/NTNU, Trondheim-Norway; Augusto L. Podio/ University of Texas, Austin, Austin TX-USA, pp. 539-546.

(Continued)

*Primary Examiner*—Jennifer H. Gay
(74) *Attorney, Agent, or Firm*—Sughrue Mion, PLLC

(57) ABSTRACT

A closed-loop circulating system for drilling wells has control of the flow rates in and out of the wellbore. Kicks and fluid losses are quickly controlled by adjusting the backpressure. Kick tolerance and tripping margins are eliminated by real-time determination of pore and fracture pressure. The system can incorporate a rotating BOP and can be used with underbalanced drilling.

18 Claims, 7 Drawing Sheets

U.S. PATENT DOCUMENTS

| | | | | | |
|---|---|---|---|---|---|
| 5,006,845 | A | * | 4/1991 | Calcar et al. | 367/81 |
| 5,063,776 | A | * | 11/1991 | Zanker et al. | 73/152.21 |
| 5,070,949 | A | | 12/1991 | Gavignet | |
| 5,080,182 | A | | 1/1992 | Thompson | |
| 5,115,871 | A | | 5/1992 | McCann et al. | |
| 5,144,589 | A | | 9/1992 | Hardage | |
| 5,154,078 | A | | 10/1992 | Codazzi | |
| 5,161,409 | A | * | 11/1992 | Hughes et al. | 73/152.19 |
| 5,200,929 | A | | 4/1993 | Bowers | |
| 5,205,165 | A | | 4/1993 | Jardine et al. | |
| 5,205,166 | A | | 4/1993 | McCann et al. | |
| 5,635,636 | A | * | 6/1997 | Alexander | 73/152.29 |
| 5,975,219 | A | | 11/1999 | Sprehe | |
| 6,234,030 | B1 | | 5/2001 | Butler | |
| 6,240,787 | B1 | * | 6/2001 | Alexander | 73/861.49 |
| 6,410,862 | B1 | * | 6/2002 | Lecann | 177/17 |
| 6,434,435 | B1 | * | 8/2002 | Tubel et al. | 700/30 |
| 6,618,677 | B1 | * | 9/2003 | Brown | 702/13 |
| 6,668,943 | B1 | * | 12/2003 | Maus et al. | 175/5 |
| 6,820,702 | B1 | * | 11/2004 | Niedermayr et al. | 175/57 |
| 2002/0112888 | A1 | * | 8/2002 | Leuchtenberg | 175/48 |
| 2003/0168258 | A1 | * | 9/2003 | Koederitz | 175/38 |
| 2004/0040746 | A1 | * | 3/2004 | Niedermayr et al. | 175/38 |

FOREIGN PATENT DOCUMENTS

| | | | |
|---|---|---|---|
| EP | 0302558 | A1 | 2/1989 |
| EP | 0466229 | A1 | 1/1992 |
| EP | 1 048 819 | A1 | 11/2000 |
| GB | 2142679 | A | 1/1985 |
| GB | 2 290 330 | A | 12/1995 |
| WO | WO 99/49172 | | 9/1999 |
| WO | WO 00/75477 | A1 | 12/2000 |

OTHER PUBLICATIONS

IADC/SPE 39400, Drilling Conference 1998, "Early Kick Detection Through Liquid Level monitoring in the Wellbore", J.J. Schubert, Texas A&M U., and J.C. Wright, Conoco Inc, pp. 889-895.

SPE 49114, Drilling Conference 1998, "Using Downhole Annular Pressure Measurements to Anticipate Drilling Problems", Mark Hutchinson, Anadrill and Iain Rezmer-Cooper, Schlumberger, pp. 535-549.

IADC/SPE 59160, Drilling Conference 2000, "Reeled Pipe Technology for Deepwater Drilling Utilizing a Dual Gradient Mud System", P. Fontana and G. Sjoberg, DeepVision LLC.

E.Y. Nakagawa et al., "Application of Aerated-fluid drilling in Deep Water" World Oil, Gulf Publishing Co., Houston, US, vol. 220, No. 6, Jun. 1999, pp. 47-50, XP000831481, ISSN: 0043-8790.

Z. Wang et al..: "Underbalanced Drilling Model Simulates Dynamic Well Bore Conditions" Oil and Gas Journal, Pennwell Publishing Co., Tulsa, US, vol. 95, No. 27, Jul. 7, 1997, pp. 62-66, XP000703729, ISSN: 0030-1388.

J.J. Schubert et al., "Early Kick Detection Through Liquid Level Monitoring in the Wellbore," IADC/SPE 39400 Drilling Conference, Copyright 1998, pp. 1-7, Dallas, Texas.

Pal Skalle et al., "Trends Extracted from 800 Gulf Coast Blowouts During 1960-1996," IADC/SPE 39354 Drilling Conference, Copyright 1998, pp. 1-8, Dallas, Texas.

P. Fontana et al., "Reeled Pipe Technology for Deepwater Drilling Utilizing a Dual Gradient Mud System," IADC/SPE 59160 Drilling Conference, Copyright 2000, pp. 1-14, New Orleans, Louisiana.

Mark Hutchinson et al., "Using Downhole Annular Pressure Measurements to Anticipate Drilling Problems," Society of Petroleum Engineers, Inc., Copyright 1998, pp. 535-549, New Orleans, Louisiana.

* cited by examiner

STATE-OF-THE-ART

STATE-OF-THE-ART

DRILLING SYSTEM AND METHOD

This is a Continuation-In Part of application Ser. No. 09/737,851, filed Dec. 18, 2000 now abandoned, the disclosure of which is incorporated herein by reference.

FIELD OF THE INVENTION

The present invention deals with a closed-loop system for drilling wells where a series of equipment, for the monitoring of the flow rates in and out of the well, as well as for adjusting the back pressure, allows the regulation of the out flow so that the out flow is constantly adjusted to the expected value at all times. A pressure containment device keeps the well closed at all times. Since this provides a much safer operation, its application for exploratory wells will greatly reduce the risk of blow-outs. In environments with narrow margin between the pore and fracture pressure, it will create a step change compared to conventional drilling practice. In this context, applications in deep and ultra-deep water are included. A method for drilling, using said system, is also disclosed. The drilling system and method are suited for all types of wells, onshore and offshore, using a conventional drilling fluid or a lightweight drilling fluid, more particularly a substantially incompressible conventional or lightweight drilling fluid.

BACKGROUND INFORMATION

Drilling oil/gas/geothermal wells has been done in a similar way for decades. Basically, a drilling fluid with a density high enough to counter balance the pressure of the fluids in the reservoir rock, is used inside the wellbore to avoid uncontrolled production of such fluids. However, in many situations, it can happen that the bottomhole pressure is reduced below the reservoir fluid pressure. At this moment, an influx of gas, oil, or water occurs, named a kick. If the kick is detected in the early stages, it is relatively simple and safe to circulate the invaded fluid out of the well. After the original situation is restored, the drilling activity can proceed. However, if, by any means, the detection of such a kick takes a long time, the situation can become out of control leading to a blowout. According to Skalle, P. and Podio, A. L. in "Trends extracted from 800 Gulf Coast blow-outs during 1960–1996" IADC/SPE 39354, Dallas, Tex., March 1998, nearly 0.16% of the kicks lead to a blowout, due to several causes, including equipment failures and human errors.

On the other hand, if the wellbore pressure is excessively high, it overcomes the fracture strength of the rock. In this case loss of drilling fluid to the formation is observed, causing potential danger due to the reduction in hydrostatic head inside the wellbore. This reduction can lead to a subsequent kick.

In the traditional drilling practice, the well is open to the atmosphere, and the drilling fluid pressure (static pressure plus dynamic pressure when the fluid is circulating) at the bottom of the hole is the sole factor for preventing the formation fluids from entering the well. This induced well pressure, which by default, is greater than the reservoir pressure causes a lot of damage, i.e., reduction of near wellbore permeability, through fluid loss to the formation, reducing the productivity of the reservoir in the majority of cases.

Since among the most dangerous events while drilling conventionally is to take a kick, there have been several methods, equipment, procedures, and techniques documented to detect a kick as early as possible. The easiest and most popular method is to compare the injection flow rate to the return flow rate. Disregarding the drilled cuttings and any loss of fluid to the formation, the return flow rate should be the same as the injected one. If there are any significant discrepancies, drilling is stopped to check if the well is flowing with the mud pumps off. If the well is flowing, the next action to take is to close the blow-out preventer equipment (BOP), check the pressures developed without circulation, and then circulate the kick out, adjusting the mud weight accordingly to prevent further influx. Some companies do not check flow if there is an indication that an influx may have occurred, closing the BOP as the first step.

This procedure takes time and increases the risk of blow-out, if the rig crew does not quickly suspect and react to the occurrence of a kick. Procedure to shut-in the well can fail at some point, and the kick can be suddenly out of control. In addition to the time spent to control the kicks and to adjust drilling parameters, the risk of a blow-out is significant when drilling conventionally, with the well open to the atmosphere at all times.

The patent literature includes several examples of methods for kick detection, including U.S. Pat. No. 4,733,233 (Grosso) which discloses a method for kick detection using a downhole device, known as an MWD, instead of detecting by fluid flow. An MWD measures gas kick only, by wave perturbations which are created ahead of the influx and detected. This method does not detect liquid (water or oil) kicks.

Among the methods available to quickly detect a kick the most recent ones are presented by Hutchinson, M and Rezmer-Cooper, I. in "Using Downhole Annular Pressure Measurements to Anticipate Drilling Problems", SPE 49114, SPE Annual Technical Conference and Exhibition, New Orleans, La., 27–30 September, 1998. Measurement of different parameters, such as downhole annular pressure in conjunction with special control systems, adds more safety to the whole procedure. The paper discusses such important parameters as the influence of ECD (Equivalent Circulating Density, which is the hydrostatic pressure plus the friction losses while circulating the fluid, converted to equivalent mud density at the bottom of the well) on the annular pressure. It is also pointed out that if there is a tight margin between the pore pressure and fracture gradients, then annular pressure data can be used to make adjustments to mud weight. But, essentially, the drilling method is the conventional one, with some more parameters being recorded and controlled. Sometimes, calculations with these parameters are necessary to define the mud weight required to kill the well. However, annular pressure data recorded during kill operations have also revealed that conventional killing procedures do not always succeed in keeping the bottomhole pressure constant.

In some methods it is conventional to estimate pore pressure on detection of a kick in order to circulate the kick out of the well. U.S. Pat. No. 5,115,871 (McCann) discloses a method to estimate pore pressure while drilling by monitoring two parameters and monitoring respective change therein. GB 2 290 330 (Baroid Technology Inc) discloses a method of controlling drilling by estimating pore pressure from continually evaluated parameters, to take into account wear of drill bit.

Other publications deal with methods to circulate the kick out of the well. For example, U.S. Pat. No. 4,867,254 teaches a method of real time control of fluid influxes into an oil well from an underground formation during drilling.

The injection pressure $p_i$ and return pressure $p_r$ and the flow rate Q of the drilling mud circulating in the well are measured. From the pressure and flow rate values, the value of the mass of gas $M_g$ in the annulus is determined, and the changes in this value monitored in order to determine either a fresh gas entry into the annulus or a drilling mud loss into the formation being drilled.

U.S. Pat. No. 5,080,182 teaches a method of real time analysis and control of a fluid influx from an underground formation into a wellbore being drilled with a drill string while drilling and circulating from the surface down to the bottom of the hole into the drill string and flowing back to the surface in the annulus defined between the wall of the wellbore and the drill string, the method comprising the steps of shutting-in the well, when the influx is detected; measuring the inlet pressure $P_i$ or outlet pressure $P_o$ of the drilling mud as a function of time at the surface; determining from the increase of the mud pressure measurement, the time $t_c$ corresponding to the minimum gradient in the increase of the mud pressure and controlling the well from the time $t_c$.

U.S. Pat. No. 3,470,971 (Dower) and U.S. Pat. No. 5,070,949 (Gavignet) are further examples of kick circulation methods. Dower discloses an automated method for kick circulation, intended to keep wellbore pressure constant by adjusting back pressure by means of a choke during circulation. Gavignet discloses a method which comprises measuring gas in the annulus as the fluid influx travels upwards during circulation.

It is observed that in all the cited literature where the drilling method is the conventional one, the shut-in procedure is carried out in the same way. That is, literature methods are directed to the detection and correction of a problem (the kick), while there are no known methods directed to eliminating said problem, by changing or improving the conventional method of drilling wells. Thus, according to drilling methods cited in the literature, the kicks are merely controlled.

In the last 10 years, a new drilling technique, underbalanced drilling (UBD) is becoming more and more popular. This technique implies a concomitant production of the reservoir fluids while drilling the well. Special equipment has been developed to keep the well closed at all times, as the wellhead pressure in this case is not atmospheric, as in the traditional drilling method. Also, special separation equipment must be provided to properly separate the drilling fluid from the gas, and/or oil, and/or water and drilled cuttings.

EP 1 048 819 (Baker-Hughes) discloses an UBD method, and regulates injection of different fluid types to maintain a downhole pressure which ensures underbalance condition. U.S. Pat. No. 5,975,219 (Sprehe) is not as such designed as an UBD method, rather as a method which operates with a closed well head when drilling with a gas drilling fluid only, in order to contain the gas. However there are similarities to the UBD method.

The UBD technique has been developed initially to overcome severe problems faced while drilling, such as massive loss of circulation, stuck pipe due to differential pressure when drilling depleted reservoirs, as well as to increase the rate of penetration. In many situations, however, it will not be possible to drill a well in the underbalanced mode, e.g., in regions where to keep the wellbore walls stable a high pressure inside the wellbore is needed. In this case, if the wellbore pressure is reduced to low levels to allow production of fluids the wall collapses and drilling cannot proceed.

Accordingly, the present application relates to a new concept of drilling whereby a method and corresponding instrumentation allows that kicks may be detected early and controlled much quicker and safer or even eliminated/mitigated than in prior art methods.

Further, it should be noted that the present method operates with the well closed at all times. That is why it can be said that the method, herein disclosed and claimed, is much safer than conventional ones.

In wells with severe loss of circulation, there is no possibility to detect an influx by observing the return flow rate. Schubert, I. J. and Wright, J. C. in "Early kick detection through liquid level monitoring in the wellbore", IADC/SPE 39400, Dallas, Tex., March 1998 propose a method of early detection of a kick through liquid level monitoring in the wellbore. Having the wellbore open to atmosphere, here again the immediate step after detecting a kick is to close the BOP and contain the well.

The excellent review of 800 blow-outs occurred in Alabama, Texas, Louisiana, Mississipi, and offshore in the Gulf of Mexico cited hereinbefore by Skalle, P. and Podio, A. L. in "Trends extracted from 800 Gulf Coast blow-outs during 1960–1996" IADC/SPE 39354, Dallas, Tex., March 1998 shows that the main cause of blow-outs is human error and equipment failure.

Nowadays, more and more oil exploration and production is moving towards challenging environments, such as deep and ultra-deepwater. Also, wells are now drilled in areas with increasing environmental and technical risks. In this context, one of the big problems today, in many locations, is the narrow margin between the pore pressure (pressure of the fluids—water, gas, or oil—inside the pores of the rock) and the fracture pressure of the formation (pressure that causes the rock to fracture). The well is designed based on these two curves, used to define the extent of the wellbore that can be left exposed, i.e., not cased off with pipe or other form of isolation, which prevents the direct transmission of fluid pressure to the formation. The period or interval between isolation implementation is known as a phase.

In some situations a collapse pressure (pressure that causes the wellbore wall to fall into the well) curve is the lower limit, rather than the pore pressure curve. But, for the sake of simplicity, just the two curves should be considered, the pore pressure and fracture pressure one. A phase of the well is defined by the maximum and minimum possible mud weight, considering the curves mentioned previously and some design criteria that varies among the operators, such as kick tolerance and tripping margin. In case of a kick of gas, the movement of the gas upward the well causes changes in the bottomhole pressure. The bottomhole pressure increases when the gas goes up with the well closed. Kick tolerance is the change in this bottomhole pressure for a certain volume of gas kick taken.

Tripping margin, on the other hand, is the value that the operators use to allow for pressure swab when tripping out of the hole, to change a bit, for example. In this situation, a reduction in bottomhole pressure, caused by the upward movement of the drill string can lead to an influx.

According to FIG. 1 attached, based on prior art designing of wells for drilling, typically a margin of 0.3 pound per gallon (ppg) is added to the pore pressure to allow a safety factor when stopping circulation of the fluid and subtracted from the fracture pressure, reducing even more the narrow margin, as shown by the dotted lines. Since the plot shown in FIG. 1 is always referenced to the static mud pressure, the compensation of 0.3 ppg allows for the dynamic effect while drilling also. The compensation varies from scenario to scenario but typically lies between 0.2 and 0.5 ppg.

From FIG. 1, it can be seen that the last phase of the well can only have a maximum length of 3,000 ft, since the mud weight at this point starts to fracture the rock, causing mud losses. If a lower mud weight is used, a kick will happen at the lower portion of the well. It is not difficult to imagine the problems created by drilling in a narrow margin, with the requirement of several casing strings, increasing tremendously the cost of the well. In some critical cases, a difference as small as 0.2 ppg is found between the pore and fracture pressures. Moreover, the current well design shown in FIG. 1 does not allow to reach the total depth required, since the bit size is continuously reduced to install the several casing strings needed. In most of these wells, drilling is interrupted to check if the well is flowing, and frequent mud losses are also encountered. In many cases wells need to be abandoned, leaving the operators with huge losses.

These problems are further compounded and complicated by the density variations caused by temperature changes along the wellbore, especially in deepwater wells. This can lead to significant problems, relative to the narrow margin, when wells are shut in to detect kicks/fluid losses. The cooling effect and subsequent density changes can modify the ECD due to the temperature effect on mud viscosity, and due to the density increase leading to further complications on resuming circulation. Thus using the conventional method for wells in ultra deep water is rapidly reaching technical limits.

On the contrary, in the present application the 0.3 ppg margins referred to in FIG. 1 are dispensed with during the planning of the well since the actual required values of pore and fracture pressures will be determined during drilling. Thus, the phase of the well can be further extended and consequently the number of casing strings required is greatly reduced, with significant savings. If the case of FIG. 1 is considered, the illustrated number of casings is 10, while by graphically applying the method of the invention this number is reduced to 6, according to FIG. 2 attached. This may be readily seen by considering only the solid lines of pore and fracture gradient to define the extent of each phase, rather than the dotted lines denoting the limits that are in conventional use. In order to overcome these problems, the industry has devoted a lot of time and resources to develop alternatives. Most of these alternatives deal with the dual-density concept, which implies a variable pressure profile along the well, making it possible to reduce the number of casing strings required. In some drilling scenarios, such as in areas where higher than normal pore pressure is found in deepwater locations, the dual density drilling system is the only one that may render the drilling economical.

The idea is to have a curved pressure profile, following the pore pressure curve. There are two basic options:

- injection of a lower density fluid (oil, gas, liquid with hollow glass spheres) at some point for example WO 00/75477 (Exxon Mobil) which operates with injection of a gas phase lightweight fluid in a system having pressure control devices at the wellhead and at the seabed and detects changes in seabed pressure at the wellhead and compensates accordingly);
- placement of a pump at the bottom of the sea to lift the fluid up to the surface installation for example WO 00/49172 (Hydril Co) which uses a choke to regulate the return flow and the well bore pressure to a preselected level.

There are advantages and disadvantages of each system proposed above. The industry has mainly taken the direction of the second alternative, due to arguments that well control and understanding of two-phase flow complicates the whole drilling operation with gas injection.

Thus, according to the IADC/SPE 59160 paper "Reeled Pipe Technology for Deepwater Drilling Utilizing a Dual Gradient Mud System", by P. Fontana and G. Sjoberg, it is possible to reduce casing strings required to achieve the final depth of the well by returning the drilling fluid to the vessel with the use of a subsea pumping system. The combination of seawater gradient at the mud line and drilling fluid in the wellbore results in a bottomhole equivalent density that can be increased as illustrated in FIG. 2 of the paper. The result is a greater depth for each casing string and reduction in total number of casing strings. It is alleged that larger casing can then be set in the producing formation and deeper overall well depths can be achieved. The mechanism used to create a dual gradient system is based on a pump located at the sea bottom.

However, there are several technical issues to be overcome with this option, which will delay field application for some years. The cost of such systems is also another negative aspect. Potential problems with subsea equipment will make any repair or problem turn into a long down-time for the rig, increasing even further the cost of exploration.

Another method currently under development by the industry is the injection of liquid slurry containing lightweight spheres at the bottom of the ocean, in the annulus, and injecting conventional fluid through the drillstring. The combination of the light slurry and the conventional fluid coming up the annulus creates a lighter fluid above the bottom of the ocean, and a denser fluid below the bottom of the ocean. This method creates also a dual-density gradient drilling or DGD. This alternative is much simpler than the expensive mud lift methods, but there are still some problems and limitations, such as the separation of the spheres from the liquid coming up the riser, so that they can be injected again at the bottom of the ocean. The slurry injected at the bottom of the ocean has a high concentration of spheres, whereas the drilling fluid being injected through the drillstring does not have any sphere, therefore the requirement for separation of the spheres at the surface.

One approach in DGD is currently being developed by Maurer Technology using oilfield mud pumps to pump hollow spheres to the seafloor and inject the lightweight spheres into the riser to reduce the density of the drilling mud in the riser to that of the seawater. It is alleged that the use of oilfield mud pumps instead of the subsea pumping DGD systems currently being developed will significantly reduce operational costs.

A safety requirement for offshore drilling with a floating drilling unit is to have inside the well, below the mud line, a drilling fluid having sufficient weight to balance the highest pore pressure of an exposed drilled section of the well. This requirement stems from the fact that an emergency disconnection might happen, and all of a sudden, the hydrostatic column provided by the mud inside the marine riser is abruptly lost. The pressure provided by the mud weight is suddenly replaced by seawater. If the weight of the fluid remaining inside the well after the disconnection of the riser is not high enough to balance the pore pressure of the exposed formations, a blowout might occur. This safety guard is called Riser Margin, and currently there are several wells being drilled without this Riser Margin, since there is no dual-density method commercially available so far.

There are three other main methods of closed system drilling: a) underbalanced flow drilling, which involves flowing fluids from the reservoir continuously into the wellbore is described and documented in the literature; b) mud-cap drilling, which involves continuous loss of drilling fluid to the formation, in which fluid can be overbalanced, balanced or underbalanced is also documented; c) air drilling, where air or other gas phase is used as the drilling fluid. These methods have limited application, i.e., underbalanced and air drilling are limited to formations with stable wellbores, and there are significant equipment and procedural limitations in handling produced effluent from the wellbore. The underbalanced method is used for limited sections of the wellbore, typically the reservoir section. This limited application makes it a specialist alternative to conventional drilling under the right conditions and design criteria. Air drilling is limited to dry formations due to its limited capability to handle fluid influxes. Similarly Mud-Cap drilling is limited to specific reservoir sections (typically highly fractured vugular carbonates).

Thus, the open literature is extremely rich in pointing out methods for detecting kicks, and then methods for circulating kicks out of the wellbore. Generally all references teach methods that operate under conventional drilling conditions, that is, with the well being open to the atmosphere. However, there is no suggestion nor description of a modified drilling method and system, which, by operating with the well closed, controlling the flow rates in and out of the wellbore, and adjusting the pressure inside the wellbore as required, causing that influxes (kicks) and fluid losses do not occur or are extremely minimized, such method and system being described and claimed in the present application. In a particular advantage of the present invention the system and method differ from UBD methods which operate with closed well but generate a constant controlled influx of fluid, as hereinbefore described. Moreover the system and method are adapted for operation with a substantially incompressible drilling fluid whereby changes in pressure/flow may be detected or made at the wellhead and the effect downhole may be accurately calculated without complex pressure differential considerations. Nevertheless for offshore drilling, the present method and system employing back pressures can also be used with lightweight fluids so that the equivalent drilling fluid weight above the mud line can be set lower than the equivalent fluid weight inside the wellbore, with increasing safety and low cost relative to drilling with conventional fluids.

SUMMARY OF THE INVENTION

In its broadest aspect the present invention is directed to a system for operating a well having a drilling fluid circulating therethrough comprising means for monitoring the flow rates in and out and means to predict a calculated value of flow out at any given time to obtain real time information on discrepancy between predicted and monitored flow out, thereby producing an early detection of influx or loss of drilling fluid, the well being closed with a pressure containment device at all times.

The pressure/containment device may be a rotating blow out preventer (BOP) or a rotating control head, but is not limited to it. The location of the device is not critical. It may be located at the surface or at some point further down e.g. on the sea floor, inside the wellbore, or at any other suitable location. The type and design of device is not critical and depends on each well being drilled. It may be standard equipment that is commercially available or readily adapted from existing designs.

The function of the rotating pressure containment device is to allow the drill string to pass through it and rotate, if a rotating drilling activity is carried on, with the device closed, thereby creating a back pressure in the well. Thus, the drill string is stripped through the rotating pressure containment device which closes the annulus between the outside of the drill pipe and the inside of the wellbore/casing/riser. A simplified pressure containment device may be a BOP designed to allow continuous passage of non-jointed pipe such as the stripper(s) on coiled tubing operations.

The well preferably comprises a pressure containment device which is closed at all times, and a reserve BOP which can be closed as a safety measure in case of any uncontrolled event occurring.

Reference herein to a well is to an oil, gas or geothermal well which may be onshore, offshore, deepwater or ultra-deepwater or the like. Reference herein to circulating drilling fluid is to what is commonly termed the mud circuit, the circulation of the drilling fluid down the wellbore may be through a drill string and the return through an annulus, as in prior art methods, but not limited to it. As a matter of fact, any way of circulation of the drilling fluid may be successfully employed in the practice of the present system and method, no matter where the fluids are injected or returned.

As regards the drilling fluid, according to one embodiment of the invention, conventional drilling fluids may be used, selected typically from incompressible fluids such as oil and/or water liquid phase fluids, and optionally additionally minor amounts of gas phase fluid. When the liquid phase is oil, the oil can be diesel, synthetic, mineral, or vegetable oil, the advantage being the reduced density of oil compared to water, and the disadvantage being the strong negative effect on the environment.

Means for monitoring of flow rates may be for monitoring of mass and/or volume flow. In a particularly preferred embodiment the system and method of the invention comprises monitoring the mass flow in and out of the well, optionally together with other parameters that produce an early detection of influx or loss independent of the mass flow in and out at that point in time. Preferably monitoring means are operated continuously throughout a given operation. Preferably monitoring is with commercially available mass and flow meters, which may be standard or multiphase. Meters are located on lines in and out.

The system may be for actively drilling a well or for related inactive operation, for example the real time determination of the pore pressure or fracture pressure of a well by means of a direct reading of parameters relating to a fluid influx or loss respectively; alternatively or additionally the system is for detecting an influx and sampling to analyse the nature of the fluid which can be produced by the well.

In a further aspect of the invention there is provided a system for operating a well having a drilling fluid circulating therethrough comprising in response to detection of an influx or loss of drilling fluid, means for preemptively adjusting back pressure in the wellbore based on influx or loss indication before surface system detection, the well being closed with a pressure containment device at all times.

In this system an influx may be detected by means as hereinbefore defined comprising detecting a real time discrepancy between predicted and monitored flow out as hereinbefore defined, or by means such as downhole temperature sensors, downhole hydrocarbon sensors, pressure change sensors and pressure pulse sensors.

In this aspect of the invention the well comprises additionally one or more pressure/flow control devices and means for adjustment thereof to regulate fluid out flow to the predicted ideal value at all times, or to preemptively adjust the backpressure to change the ECD (Equivalent Circulating Density) instantaneously in response to an early detection of influx or fluid loss.

Means for adjustment of the pressure/flow control device suitably comprises means for closing or opening thereof, to the extent required to increase or reduce respectively the backpressure, adjusting the ECD.

Preferably pressure/flow control devices are located anywhere suited for the purpose of creating or maintaining a backpressure on the well, for example on a return line for recovering fluid from the well.

Reference herein to ECD is to the hydrostatic pressure plus friction losses occurring while circulating fluid, converted to equivalent mud density at the bottom of the well.

Preferably adjustment of pressure/flow control devices is instantaneous and may be manual or automatic. The level of adjustment may be estimated, calculated or simply a trial adjustment to observe the response and may comprise opening or closing the control device for a given period, aperture and intervals. Preferably adjustment is calculated based on assumptions relating to the nature of the fluid influx or loss.

The pressure/flow control device may be any suitable devices for the purpose such as restrictions, chokes and the like having means for regulation thereof and may be commercially available or may be specifically designed for the required purpose and chosen or designed according to the well parameters such as diameter of the return line, pressure and flow requirements.

In a very broad way, the system and method of the invention comprises adjusting the wellbore pressure with the aid of a pressure/flow control device to correct the bottomhole pressure to prevent fluid influx or losses in a pro-active as opposed to the prior art reactive manner.

Closing or opening the pressure/flow control device restores the balance of flow and the predicted value, the bottomhole pressure regaining a value that avoids any further influx or loss, whereafter the fluid that has entered the well is circulated out or lost fluid is replaced.

Running the fluid (mud) density at a value slightly lower than that required to control the formation pressure and adjusting backpressure on the well by means of the flow, exerts an extremely controllable ECD at the bottomhole that has the flexibility to be adjusted up or down.

Preferably the one or more pressure/flow control devices are controlled by a central means which calculates adjustment.

Adjustment of the pressure/flow control device is suitably by closing or opening to the extent required to increase or reduce respectively the backpressure, adjusting the ECD.

In this case the system may be used as a system for controlling the ECD in any desired operation and continuously or intermittently drilling a gas, oil or geothermal well wherein drilling is carried out with bottom hole pressure controlled between the pore pressure and the fracture pressure of the well, being able to directly determine both values if desired, or drilling with the exact bottom hole pressure needed, with a direct determination of the pore pressure, or drilling with bottom hole pressure regulated to be just less than the pore pressure thus generating a controlled influx, which may be momentary in order to sample the well fluid in controlled manner, or may be continuous in order to produce well fluid in controlled manner.

Preferably therefore the system of the present invention is for drilling a well while injecting a drilling fluid through an injection line of said well and recovering through a return line of said well where the well is closed at all times, and comprises a pressure containment device and pressure/flow control device to a wellbore to establish and/or maintain a back pressure on the well, means to monitor the fluid flow in and out, means to monitor flow of any other material in and out, means to monitor parameters affecting the monitored flow value and means to predict a calculated value of flow out at any given time and to obtain real time information on discrepancy between predicted and monitored flow out and converting to a value for adjusting the pressure/flow control device and restoring the predicted flow value.

The system and corresponding method of drilling oil, gas and geothermal wells according to the present invention is based on the principle of mass conservation, a universal law. Measurements are effected under the same dynamic conditions as those when the actual events occur.

While drilling a well, loss of fluid to the rock or influx from the reservoir is common, and should be avoided to eliminate several problems. By applying the principle of mass conservation, the difference in mass being injected and returned from the well, compensated for increase in hole volume, additional mass of rock returning and other relevant factors, including but not limited to thermal expansion/contraction and compressibility changes, is a clear indication of what is happening downhole.

Preferably therefore, the expression "mass flow" as used herein means the total mass flow being injected and returned, comprised of liquid, solids, and possibly gas.

In order to increase the accuracy of the method and to expedite detection of any undesired event, the flow rates in and out of the well are also monitored at all times. This way, the calculation of the predicted, ideal return flow of the well can be done with a certain redundancy and the detection of any discrepancy can be made with reduced risks.

In some cases measurement of the flow rate only is not accurate enough to provide a clear indication of losses or gains while drilling. Preferably therefore the present system envisages the addition of an accurate mass flow metering means that allows the present drilling method to be much safer than prior art drilling methods.

We have found by means of the system and method of the invention that the generation of real time metering using a full mass balance and time compensation as a dynamic predictive tool, which can be compensated also for any operational pause in drilling or fluid injection enables for the first time an adjustment of fluid return rate while continuing normal operations. This is in contrast to known open well systems which require pausing fluid injection and drilling to unload excess fluid, and add additional fluid, by trial and error until pressure is restored, which can take a matter of hours of fluid circulation to restore levels. Moreover the system provides for the first time a means for immediate restoration of pressure, by virtue of the use of a closed system whereby addition or unloading of fluid immediately affects the well backpressure.

The speed of adjustment is much greater in the present method, as opposed to the conventional situation, where increasing the mud density (weighting up) or decreasing the mud density (cutting back) is a very time consuming process. The ECD is the actual pressure that needs to overcome the formation pressure to avoid influx while drilling. However, when the circulation is stopped to make a connection, for example, the friction loss is zero and thus the ECD reduces to the hydrostatic value of the mud weight. In scenarios of very narrow mud window, the margin can be as low as 0.2 ppg. In these cases, it is common to observe influxes when circulation is interrupted, increasing substantially the risks of drilling with the conventional drilling system.

On the contrary, since the present method operates with the well closed at all times which implies a back pressure at all times, means for adjusting the back pressure compensate for dynamic friction losses when the mud circulation is interrupted, avoiding the influx of reservoir fluids (kick). Thus the improved safety of the method of the invention relative to the prior art drilling methods may be clearly seen.

Replacement of the dynamic friction loss when the circulation stops can be accomplished by slowly reducing the circulation rate through the normal flow path and simultaneously closing the pressure flow/control device and trapping a backpressure that compensates for the loss in friction head.

Alternatively or additionally the back pressure adjustment can be applied by pumping fluid, independent of the normal circulating flow path, into the wellbore, to compensate for the loss in friction head, and effecting a continuous flow that allows easy control of the back pressure by adjustment of the pressure/flow control device. This fluid flow may be achieved completely independent of the normal circulating path by means of a mud pump and injection line.

Preferably the system therefore comprises additional means to pressurize the wellbore, more preferably through the annulus, independently of the current fluid injection path. This system enables changing temperature and fluid densities at any time whilst drilling or otherwise, and enables injecting fluid into the annulus while not drilling, keeping a desired bottom hole pressure during circulation stops, and continuously detecting and changes indicative of an influx or fluid loss.

The system may comprise at least one circulation bypass comprised of a pump and a dedicated fluid injection line for injecting fluid direct to the annulus or a zone thereof, and optionally a dedicated return line, together with dedicated flow meters and additional means such as pressure/flow control devices, pressure and temperature sensors and the like. This allows keeping a desired pressure downhole during circulation stops and continuously detecting any changes in the mass balance indicative of an influx or loss during a circulation stop.

Preferably the system for drilling a well while injecting a drilling fluid through an injection line of said well and recovering through a return line of said well where the well being drilled is closed at all times comprises:

a) a pressure containment device;

b) a pressure/flow control device for the outlet stream, on the return line;

c) means for measuring mass and/or volumetric flow and flow rate for the inlet and outlet streams on the injection and return lines to obtain real time mass and/or volumetric flow signals;

d) means for measuring mass and/or volumetric flow and flow rate of any other materials in and out;

e) means for directing all the flow and pressure signals so obtained to a central data acquisition and control system; and g) a central data acquisition and control system programmed with a software that can determine a real time predicted out flow and compare it to the actual out flow estimated from the mass and volumetric flow rate values and other relevant parameters.

Preferably the means c) for measuring mass flow comprises a volume flow meter and at least one pressure sensor to obtain pressure signals and optionally at least one temperature sensor to obtain temperature signals; and may be a mass flow meter comprising integral pressure and optional temperature sensors to compensate for changes in density and temperature; and the means c) for measuring flow rate comprises means for assessing the volume of the hole at any given time, as a dynamic value having regard to the continuous drilling of the hole. At least one additional pressure and optional temperature sensor may be provided to monitor other parameters that produce an early detection of influx or loss independent of the mass flow in and out at that point in time.

Means d) comprises means for measuring flow rate of all materials in and out. Thereby the mass flow metering principle is extended to include other subcomponents of the system where accuracy can be improved, such as, but not limited to means for measuring solids and gas volume/mass out, in particular for measuring the mass flux of cuttings. Preferably the system comprises additionally providing a means of measurement of drill cuttings rate, mass or volume, when required, to measure the rate of cuttings being produced from the well.

Means d) for measuring cuttings volume/mass out is any commercially available or other equipment to verify that the mass of cuttings being received back at the surface is correlated with the rate of penetration and wellbore geometry. This data allows correction of the mass flow data and allows identification of trouble events.

Commercially available apparatus for separating and measuring cuttings volume/mass out comprises a shale shaker preferably in combination with a degasser. In a more appropriate configuration, a closed 3-phase separator (liquid, solid and gas) could be installed replacing the degasser. In this case a fully closed system is achieved. This may be desirable when dealing with hostile fluids or fluids posing environmentally risks.

The central data acquisition and control system is provided with a software designed to predict an expected, ideal value for the outflow, said value being based on calculations taking into account several parameters including but not restricted to rate of penetration, rock and drilling fluid density, well diameter, in and out flow rates, cuttings return rate, bottomhole and wellhead pressures and temperatures, also rotary torque and rpm, top drive torque and rpm, rotation of drill string, mud-pit volumes, drilling depth, pipe velocity, mud temperature, mud weight, hookload, weight on bit, pump pressure, pumpstrokes, mud flows, calculated gallons/minute, gas detection and analysis, resistivity and conductivity.

Most preferably the system comprises:

a) a pressure containment device;

b) a pressure/flow control device on the outlet stream;

c) means for measuring mass flow rate on the inlet and outlet streams;

d) means for measuring volumetric flow rate on the inlet and outlet streams;

e) at least one pressure sensor to obtain pressure data;

f) optionally at least one temperature sensor to obtain temperature data;

g) a central data acquisition and control system that sets a value for an expected out flow and compares it to the actual out flow estimated from data gathered by the mass and volumetric flow rate meters as well as from pressure and temperature data, and in case of a discrepancy between the expected and actual flow values, adjusting the said pressure/flow control device to restore the outflow to the expected value.

The at least one pressure sensor may be located at any convenient location such as at the wellhead and/or at the bottom hole.

Further, by using at least two pressure/flow control devices to apply back pressure it is possible to establish a situation of dual density gradient drilling. If more than two of these devices are used, multiple-density gradient drilling conditions are created, this inventive feature being not suggested nor described in the literature.

The system may comprise two or more pressure containment devices in series throughout the wellbore whereby a pressure profile may be established throughout the well and two or more pressure control devices in series or parallel. In the system comprising more than two pressure/flow control devices in series, the pressure profile is established in independent pressure zones created throughout the length of the well, wherein restrictions or pressure/flow control devices define the interfaces of each zone.

This system is preferably used in combination with a conventional or a lightweight fluid, as hereinbefore defined. Preferably lightweight drilling fluids are employed whenever a scenario of dual density drilling is considered. Using a light fluid with the applied back pressures enables the equivalent drilling fluid weight above the mud line to be set lower than the equivalent fluid weight inside the wellbore.

Whenever a lightweight drilling fluid is used, it may be one of the well-known lightweight fluids, that is, the drilling fluid is made up of a liquid phase, either water or oil, plus the addition of gas, hollow spheres, plastic spheres, or any other light material that can be& added to the liquid phase to reduce the overall weight. According to a preferred embodiment of the invention lightweight drilling fluids may be advantageously employed even in the absence of a dual-density drilling system.

Preferably the system comprises the said central data acquisition and control system which is provided with a time-based software to allow for lag time between in and out flux. The software is preferably provided with detection filters and/or processing filters to eliminate/reduce false indications on the received mass and fluid flow data, and any other measured or detected parameters.

Preferably the system is a closed loop system, whereby monitoring means continuously provide data to the central data acquisition and control system whereby predicted flow out is continuously revised in response to any adjustment of pressure/flow control, adjusting ECD.

In a particular advantage the system of the invention comprises three safety barriers, the drilling fluid, the blowout preventer (BOP) equipment and the pressure containment device.

In a further aspect of the invention there is provided the corresponding method for operating a well having a drilling fluid circulating therethrough comprising monitoring the flow rates of fluid in and out and predicting a calculated value of flow out at any given time to obtain real time information on discrepancy between predicted and monitored flow out, thereby producing an early detection of influx or loss of drilling fluid, the well being closed with a pressure containment device at all times.

Preferably monitoring is of mass and/or volume flow. Preferably monitoring is continuous throughout a given operation.

In this case the method may be for actively drilling a well or for related inactive operation, for example the real time determination of the pore pressure or fracture pressure of a well by means of a direct reading of parameters relating to a fluid influx or loss respectively; alternatively or additionally the system is for detecting a controlled influx and sampling to analyse the nature of fluid which can be produced by the well.

In a further aspect of the invention there is provided a method for operating a well having a drilling fluid circulating therethrough comprising detecting an influx or loss of drilling fluid and preemptively adjusting back pressure in the wellbore based on influx or loss indication before surface system detection, the well being closed with a pressure containment device at all times.

An influx may be detected by any known or novel methods, particularly by novel methods selected from the method as hereinbefore defined or by downhole temperature detection, downhole hydrocarbon detection, detecting pressure changes and pressure pulses.

In a further embodiment the method comprises adjusting pressure/flow to regulate fluid outflow to the expected value at all times and control ECD at all times or to preemptively adjust the back pressure to change the equivalent circulating density (ECD) instantaneously in response to an early detection of influx or fluid loss.

As hereinbefore defined with reference to the corresponding system of the invention, the ECD is the actual pressure that needs to overcome the formation pressure to avoid influx while drilling. However, when the circulation is stopped to make a connection, for example, the friction loss is zero and thus the ECD reduces to the hydrostatic value of the mud weight.

Preferably the adjustment is instantaneous and may be manual or automatic. Level of adjustment may be estimated, calculated or simply a trial adjustment to observe the response, and may be staged, prolonged, intermittent, rapid or finite. Preferably adjustment is calculated based on assumptions relating to the nature of the influx or loss. Preferably adjustment is controlled by a central control device.

Preferably where the discrepancy between actual and predicted out flows is a fluid loss, the adjustment comprises increasing fluid flow to the extent required to reduce backpressure and counteract fluid loss; or where the discrepancy between actual and predicted out flows is a fluid gain, the adjustment comprises reducing fluid flow to the extent required to increase backpressure and counteract fluid gain to the extent required to reduce or increase respectively the backpressure, adjusting the ECD.

Increasing or reducing the flow restores the balance of flow and the predicted value, the bottomhole pressure regaining a value that avoids any further influx or loss, whereafter the fluid that has entered the well is circulated out or lost fluid is replaced.

In this case the method may be for controlling the ECD in any desired operation and continuously or intermittently drilling a gas, oil or geothermal well wherein drilling is carried out with bottom hole pressure controlled between the pore pressure and the fracture pressure of the well, or drilling with the exact bottom hole pressure needed, with a direct determination of the pore pressure, or drilling with bottom hole pressure regulated to be just less than the pore pressure thus generating a controlled influx, which may be momentary in order to sample the well fluid in controlled manner, or may be continuous in order to produce well fluid in controlled manner.

In a further aspect the corresponding method of the present invention comprises, in relation to the system of the invention as hereinbefore defined, the following steps of injecting drilling fluid through said injection line through which said fluid is made to contact said means for monitoring flow and recovering drilling fluid through said return line; collecting any other material at the surface; measuring the flow in and out of the well and collecting flow and flow rate signals; measuring parameters affecting the monitored flow value and means; directing all the collected flow, correction and flow rate signals to the said central data acquisition and control system; monitoring parameters affecting the monitored flow value and means to predict a calculated value of flow out at any given time and to obtain real time information on discrepancy between predicted and monitored flow out and converting to a value for adjusting the pressure/flow control device and restoring the predicted flow value.

Since the present method operates with the well closed at all times which implies a back pressure at all times, this back pressure may be adjusted to compensate for dynamic friction losses when the mud circulation is interrupted, avoiding the influx of reservoir fluids (kick). Thus the improved safety of the method of the invention relative to the prior art drilling methods may be clearly seen.

For operation during a stop in fluid circulation, replacement of the dynamic friction loss when the circulation stops can be accomplished by slowly reducing the circulation rate through the normal flow path and simultaneously closing the pressure flow/control device and trapping a backpressure that compensates for the loss in friction head.

Alternatively or additionally the method comprises a step wherein fluid may be additionally injected directly to the annulus or a pressure zone thereof, and optionally returned from the annulus, thereby pressurising the wellbore through the annulus, independently of the current fluid injection path, and monitoring flow, pressure and optionally temperature.

Moreover it is possible according to the invention to run the fluid (mud) density at a value slightly lower than that required to control the formation pressure and adjust backpressure on the well by means of the flow to exert an extremely controllable ECD at the bottomhole that has the flexibility to be adjusted up or down.

Preferably the method includes monitoring values such as rate of penetration, rock and drilling fluid density, well diameter, in and out flow rates, cuttings return rate, bottomhole and wellhead pressures and temperatures, torque and drag, among other parameters and calculates the predicted ideal value for the outflow.

Therefore, the present invention provides a safe method for drilling wells, since not only is the well being drilled closed at all times, but also any fluid loss or influx that occurs is more accurately and faster determined and subsequently controlled than in prior art methods.

One advantage of the present method over prior art methods is that it is able to instantly change the ECD (Equivalent Circulating Density) by adjusting the backpressure on the wellbore by closing or opening the pressure/flow control device. In this manner the method herein described and claimed incorporates early detection methods of influx/loss that are existing or yet to be developed as part of the method herein described and claimed, e.g., tools under development or that may be developed that can detect trace hydrocarbon influx, small temperature variations, pressure pulses etc. The output of these tools or technology that indicates a kick or fluid loss can be used as a feedback parameter to yield an instant reaction to the detected kick or fluid loss, thus controlling the drilling operation at all times.

As a consequence, in a patentably distinguishing manner, the method of the invention allows that drilling operations be carried out in a continuous manner, while in prior art methods drilling is stopped and mud weight is corrected in a lengthy, time-consuming step, before drilling can be resumed, after a kick or fluid loss is detected.

This leads to significant time savings as the traditional approach to dealing with influxes is very time-consuming: stopping drilling, shutting in the well, observing, measuring pressures, circulating out the influx by the accepted methods, and adjusting the mud weight. Similarly a loss of drilling fluid to the formation leads to analogous series of time-consuming events.

We have also found that the system and method of the invention provide additional advantages in terms of allowing operation with a reduced reservoir, by virtue of closed operation under back pressure. Moreover the system and method can be operated efficiently, without the need for repeated balancing of the system after any operational pause in drilling.

Preferably the method for drilling a well while injecting a drilling fluid through an injection line of said well and recovering through a return line of said well where the well being drilled is closed at all times comprising the following steps:

a) providing a pressure containment device, suitably of a type that allows passage of pipe under pressure, to a wellbore;
b) providing a pressure/flow control device to control the flow out of the well and to keep a back pressure on the well;
c) providing a central data acquisition and control system and related software;
d) providing mass flow meters in both injection and return lines;
e) providing flow rate meters in both injection and return lines;
f) providing at least one pressure sensor;
g) providing at least one temperature sensor;
h) injecting drilling fluid through said injection line through which said fluid is made to contact said mass flow meters, said fluid flow meters and said pressure and temperature sensors, and recovering drilling fluid through said return line;
i) collecting drill cuttings at the surface;
j) measuring the mass flow in and out of the well and collecting mass flow signals;
k) measuring the fluid flow rates in and out of the well and collecting fluid flow signals;
l) measuring pressure and temperature of fluid and collecting pressure and temperature signals;
m) directing all the collected flow, pressure and temperature signals to the said central data acquisition and control system;
n) the software of the central data acquisition and control system considering, at each time, the predicted flow out of the well taking into account several parameters;
o) having the actual and predicted out flows compared and checked for any discrepancy, compensated for time lags in between input and output;
p) in case of a discrepancy, having a signal sent by the central data acquisition and control system to adjust the pressure/flow control device and restore the predicted out flow rate, without interruption of the drilling operation.

Preferably the mass flow metering according to the method comprises any subcomponents designed to improve accuracy of the measurement, preferably comprises measuring the mass flux of cuttings, produced at shaker(s) and mass outflow of gas, from degasser(s), and comprise measuring the mass flow and fluid flow into the well bore through the annulus, independently of the current fluid injection path.

Preferably the method comprises additionally at i), measuring drill cuttings rate, mass or volume, when required, to measure the rate of cuttings being produced from the well.

The method comprises measuring pressure at least at the well head and/or at the bottom hole.

The invention contemplates also the use of more than one location for pressure/flow control device at different locations inside the well to apply back pressure. The method may include containing pressure at two or more locations in series, and controlling pressure/flow at two or more locations in series or parallel inside the well, to apply back pressure. Preferably the method comprises controlling pressure/flow at two or more locations in the well in series, whereby a pressure profile is established throughout the well. Preferably controlling pressure/flow at more than two locations in the well enable independent zones to be created throughout the length of the well, wherein the locations for the pressure/flow control define zone interfaces. Preferably fluid is additionally injected directly to each pressure zone of the annulus, and optionally returned from each pressure zone thereof.

The drilling fluid may be selected from water, gas, oil and combinations thereof or their lightweight fluids. Preferably a lightweight fluid comprises added hollow glass spheres or other weight reducing material. Preferably, in scenarios where the pore pressure is normal, below normal or slightly above normal, a lightweight fluid is used.

Whenever such more than one pressure/flow control devices are combined with using lightweight fluids it is possible to broaden the pressure profiles contemplated by the method, for example, locations where the fracture gradients are low and there is a narrow margin between pore and fracture pressure.

According to this embodiment of the invention, which contemplates the use of a lightweight fluid, combined with the use of two or more restrictions to apply back pressure, a huge variety of pressure profiles may be envisaged for the well. Thus, by a continuous adjustment of the back pressure it is possible to change the density of the light fluid to optimize each pressure scenario.

The main advantage of using a lightweight fluid is the possibility of starting drilling with a fluid weight less than water. This is especially important in zones with normal or below normal pressure, normal pore pressure being the pressure exerted by a column of water. In these cases, if a conventional drilling fluid is used, the initial bottomhole pressure might be already high enough to fracture the formation and cause mud losses. By starting with a lightweight fluid, the back pressure can be applied to achieve the balance required to avoid an influx, but being controlled at all times as to avoid an excessive value to cause the losses.

The present invention provides also a method of drilling where the bottomhole pressure can be very close to the pore pressure, thus reducing the overbalanced pressure usually applied on the reservoir, and consequently reducing the risk of fluid losses and subsequent contamination of the wellbore causing damage, the overall effect being that the well productivity is increased. Drilling with the bottomhole pressure close to the pore pressure also increases the rate of penetration, reducing the overall time needed to drill the well, incurring in substantial savings.

The present invention provides further a method to drill with the exact bottomhole pressure needed, with a direct determination of the pore pressure.

The present invention provides also a method for the direct determination of the fracture pressure if needed.

In a further aspect of the invention there is provided a method for the real time determination of the fracture pressure of a well being drilled with a drill string and drilling fluid circulated therethrough, while the well is kept closed at all times, said method comprising the steps of:

a) providing a pressure sensor at the bottom of the drill string;
b) having fluid and mass flow data generated collected and directed to a central data acquisition and control device that sets an expected value for fluid and mass flow;
c) the said central data acquisition and control device continuously comparing the said expected fluid and mass flow to the actual fluid and mass flow;
d) in case of a discrepancy between the expected and actual value, the said central data acquisition and control device activating a pressure/flow control device;
e) the detected discrepancy being a fluid loss, the value of the fracture pressure being obtained from a direct reading of the bottomhole pressure.

In a further aspect of the invention there is provided a method for the real-time determination of the pore pressure of a well being drilled with a drill string and drilling fluid circulated therethrough, while the well is kept closed at all times, said method comprising the steps of:

a) providing a pressure sensor at the bottom of the drill string;
b) having fluid and mass flow data generated collected and directed to a central data acquisition and control device that sets an expected value for fluid and mass flow;
c) the said central data acquisition and control device continuously comparing the said expected fluid and mass flow to the actual fluid and mass flow;
d) in case of a discrepancy between the expected and actual value, the said central data acquisition and control device activating a pressure/flow control device;
e) the detected discrepancy being an influx, the value of the pore pressure being obtained from a direct reading of the bottomhole pressure provided by the said pressure sensor.

Since both the fracture and pore pressure curves are estimated and usually are not accurate, the present invention allows a significant reduction of risk by determining either the pore pressure or the fracture pressure, or, in more critical situations, both the pore and fracture pressure curves in a very accurate mode while drilling the well. Therefore by eliminating uncertainties from pore and fracture pressures and being able to quickly react to correct any undesired event, the present method is consequently much safer than prior art drilling methods.

The present invention provides further a drilling method where the elimination of the kick tolerance and tripping margin on the design of the well is made possible, since the pore and fracture pressure will be determined in real time while drilling the well, and, therefore, no safety margin or only a small one is necessary when designing the well. The kick tolerance is not needed since there will be no interruption in the drilling operation to circulate out any gas that might have entered into the well. Also, the tripping margin is not necessary because it will be replaced by the back pressure on the well, adjusted automatically when stopping circulation.

Also, the invention provides a drilling method where a closed-loop system allowing the balance of the in and out flows may be used with a lightweight fluid as the drilling fluid.

The invention provides further a drilling method where the use of a lightweight fluid together with the closed-loop system renders the drilling safer and cheaper, besides other technical advantages in deepwater scenarios where the pore pressure is normal, below normal, or slightly above normal, being normal the pore pressure equivalent to the sea water column.

The invention provides still a drilling method of high flexibility in zones of normal or below normal pore pressure, by creating either a dual density gradient drilling in deepwater or just a single variable density gradient drilling in zones of normal or below normal pore pressure.

The invention provides still a drilling method which combines the generation of a dual density gradient drilling and a lightweight drilling fluid, this allowing it to be applied to pressure profiles where the fracture gradients are low and there are narrow margins between pore and fracture pressure.

The invention provides further a drilling method which combines the generation of a dual density gradient drilling and a lightweight drilling fluid, this allowing the density of the light fluid to be changed to optimize each pressure scenario, since the back pressure to be applied will also be continuously adjusted.

By the fast detection of any influx and by having the well closed and under pressure at all times while drilling, the present invention allows the well control procedure to be much simpler, faster, and safer, since no time is wasted in checking the flow, closing the well, measuring the pressure, changing the mud weight if needed, and circulating the kick out of the well.

In a further aspect of the invention there is provided a method for designing a system as hereinbefore defined having regard to the intended location geology and the like comprising designing parameters relating to a wellbore, sealing means, drill string, drill casing, fluid injection means at the surface and annulus evacuation means in manner to determine mass and dynamic flow by means of designing the location and nature of means to monitor fluid flow and flow rate and designing location and nature of means to adjust fluid flow, close the well, and acquire all the relevant parameters that might be available while drilling the well, and direct the acquired parameters to any means of predicting the ideal outflow to adjust the actual outflow to the predicted value.

In a further aspect of the invention there is provided control software for a system or method as hereinbefore defined, designed to predict an expected, ideal value for outflow, based on calculations taking into account several parameters, and compare the predicted ideal value with the actual, return value as measured by flow meters, said comparison yielding any discrepancies, said software also receiving as input any early detection parameters, which input triggers a chain of investigation of probable scenarios, checking of actual other parameters and other means to ascertain that an influx/loss event has occurred. Preferably the said software utilizes all parameters being acquired during the drilling operation to enhance the prediction of the predicted flow.

The software determines that, in the case that the fluid volume from the well is increasing or decreasing, after compensating for all possible factors, it is a sign that an influx or loss is happening.

Preferably the software is provided with detection filters and/or processing filters to eliminate/reduce false indications on the received mass and fluid flow data, and any other measured or detected parameters. The software preferably provides a predicted ideal value of the outflow based on calculations taking into account among others rate of penetration, rock and drilling fluid density, well diameter, in and out flow rates, cuttings return rate, bottomhole and wellhead pressures and temperatures, torque and drag, weight on bit, hook load, and injection pressures.

The software as hereinbefore defined acts on the principle of mass conservation, to determine the difference in mass being injected and returned from the well, compensates for increase in hole volume, additional mass of rock returning and other factors as an indication of the nature of the fluid event occurring downhole.

Suitably the software compensates for relevant factors such as thermal expansion/contraction and compressibility changes, solubility effects, blend and mixture effects as an indication of the nature of fluid in a fluid influx event.

Preferably in the software of the invention, detection of an influx or loss by means of the System or Method of the invention as hereinbefore defined or by any conventional system or method triggers a chain of investigation of probable influx events, starting with an assumption of fluid phase, comparing to the observation of discrepancy to check for behavioural agreement and in the event of disagreement repeating the assumption for different phases until agreement is reached.

Preferably the software of the invention, after identification of influx event, calculates the amount, location and timing of the influx or influxes and calculates an adjusted return flow rate required to circulate the fluid out and prevent further influx.

The software as hereinbefore defined includes all the necessary algorithms, empirical calculations or other method to allow accurate estimation of the hydrostatic head and friction losses including any transient effects such as changing temperature profile along the well.

Preferably the software as hereinbefore defined on identifying an influx or loss event, automatically sends a command to a pressure/flow control device designed to adjust the return flow rate so as to restore the said return flow to the predicted ideal value, thereby preemptively adjusting backpressure to immediately control the event.

Preferably the software as hereinbefore defined generates a command relating to an adjustment to the back pressure to compensate for dynamic friction losses when mud circulation is interrupted, avoiding influx of reservoir fluids.

Preferably the software as hereinbefore defined is coupled with a feedback loop to constantly monitor the reaction to each action, as well as the necessary software design, and any necessary decision system to ensure consistent operation.

In a further aspect of the invention there is provided a method of controlling a well embodied in suitable software and suitably programmed computers.

In a further aspect of the invention there is provided a module for use in association with a conventional system for operating a well which provides the essential components of the system as hereinbefore defined.

In one embodiment the module is for use in a return line of a system as hereinbefore defined comprising one or more return line segments in parallel each comprising a pressure/flow control device, optional sensors for flow out, and a degasser which is suited for insertion in a return line to operate in a desired pressure range.

The module may be for location at the ground surface or at the seabed.

In a further embodiment a module is for use in an injection line of a system as hereinbefore defined comprising a pump and optional sensors for fluid flow, and means for sealingly engaging with the well for injection into the annulus thereof.

It should be understood that all the devices used in the present system and method, such as flow metering system, pressure containment device, pressure and temperature sensors, pressure/flow control device are commercial devices and as such do not constitute an object of the invention.

Further, it is within the scope of the application that any improvements in mass/flow rate measurements or any other measuring device can be incorporated into the method. Also comprised within the scope of the application are any improvements in the accuracy and time lag to detect influx or fluid losses as well as any improvements in the system to manipulate the data and make decisions related to restore the predicted flow value.

Thus, improved detection, measurement or actuation tools are all comprised within the scope of the application.

BRIEF DESCRIPTION OF THE DRAWINGS

The method and system of the invention will now be described in more detail based on the appended FIGURES wherein FIG. 1 attached is a prior art log of pore and fracture pressure curves indicated hereinbefore. Included in this figure are the kick tolerance and tripping margin, used for designing the casing setting points, in this case taken as 0.3 ppg below the fracture pressure and above the pore pressure, respectively. This value is commonly used in the industry. On the right hand side the number and diameter of the casing strings required to safely drill this well using the current conventional drilling method is shown. As pointed out before, the two curves shown are estimated before drilling. Actual values might never be determined by the current conventional drilling method.

Figure 5:
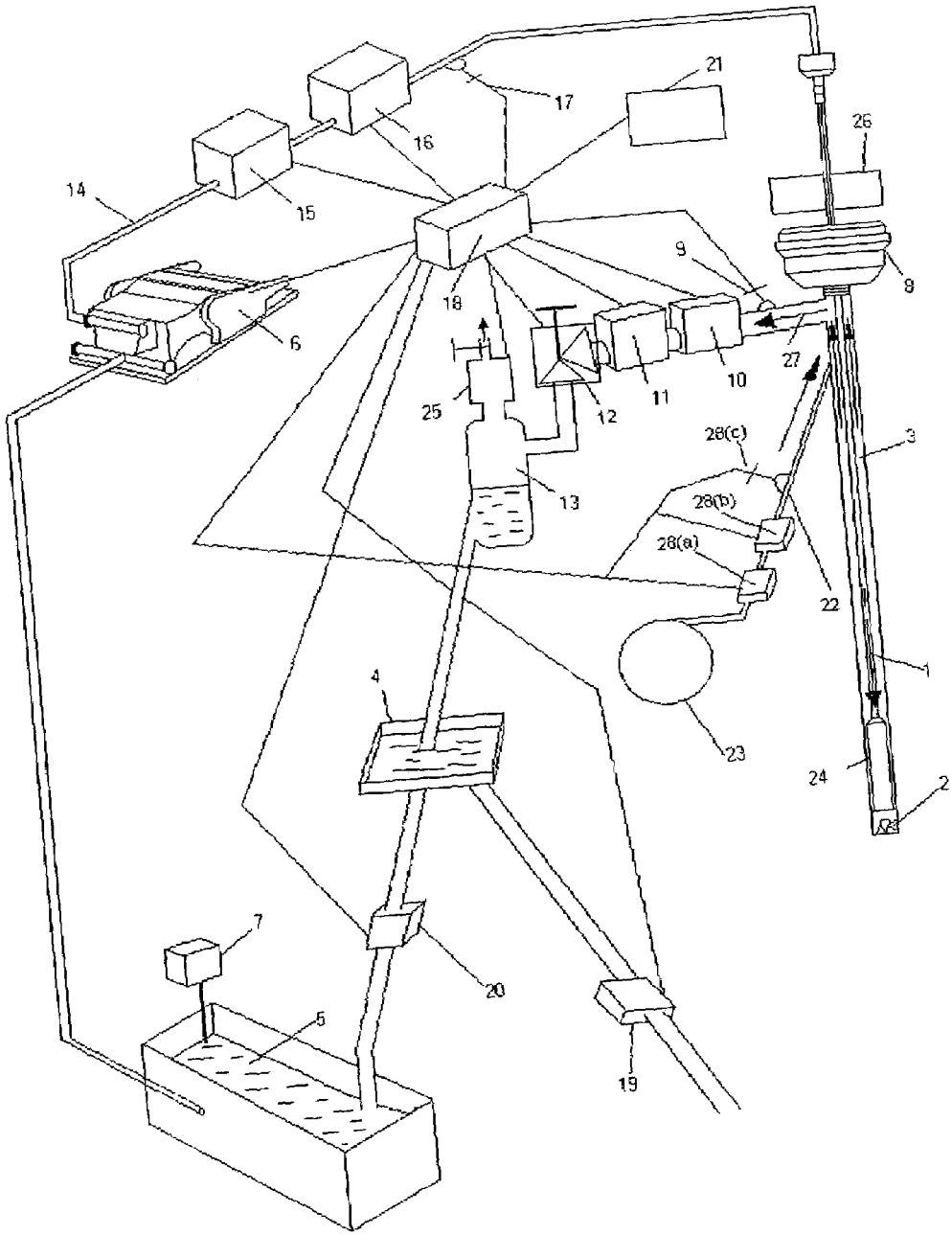
Figure 6:
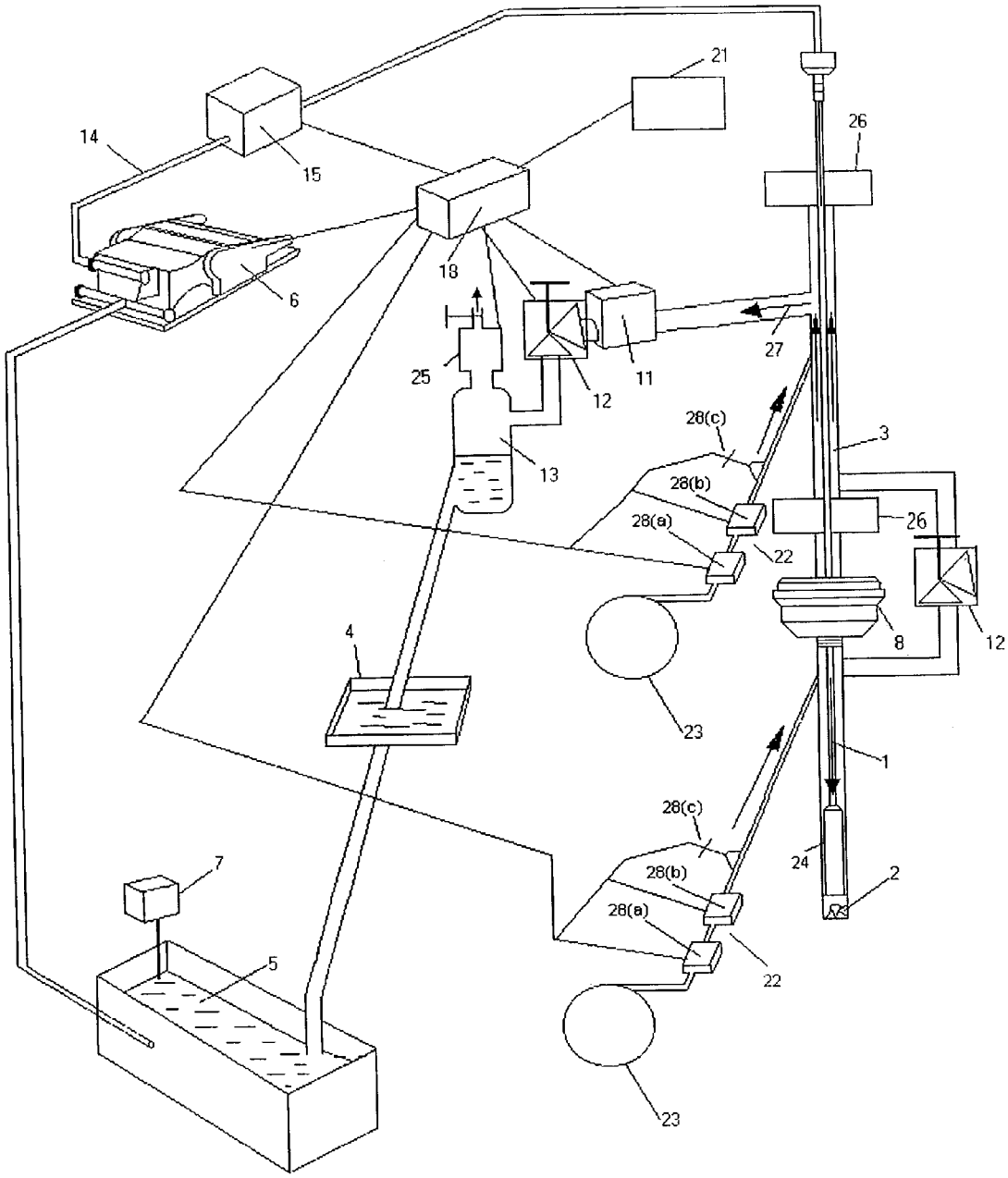

Additionally in FIGS. 5 and 6, fluid flow meters include mass flow and fluid flow rate meters, also pressure and temperature sensors, cuttings mass/volume measurement device and pressure/flow control device have been added to the standard drilling rig configuration and a control system has been added to receive data gathered and actuate the pressure/flow control device on the outlet stream.

Additionally in FIG. 6, additional pressure/flow control device(s) have been added to create distinct pressure zones.

Figure 7:
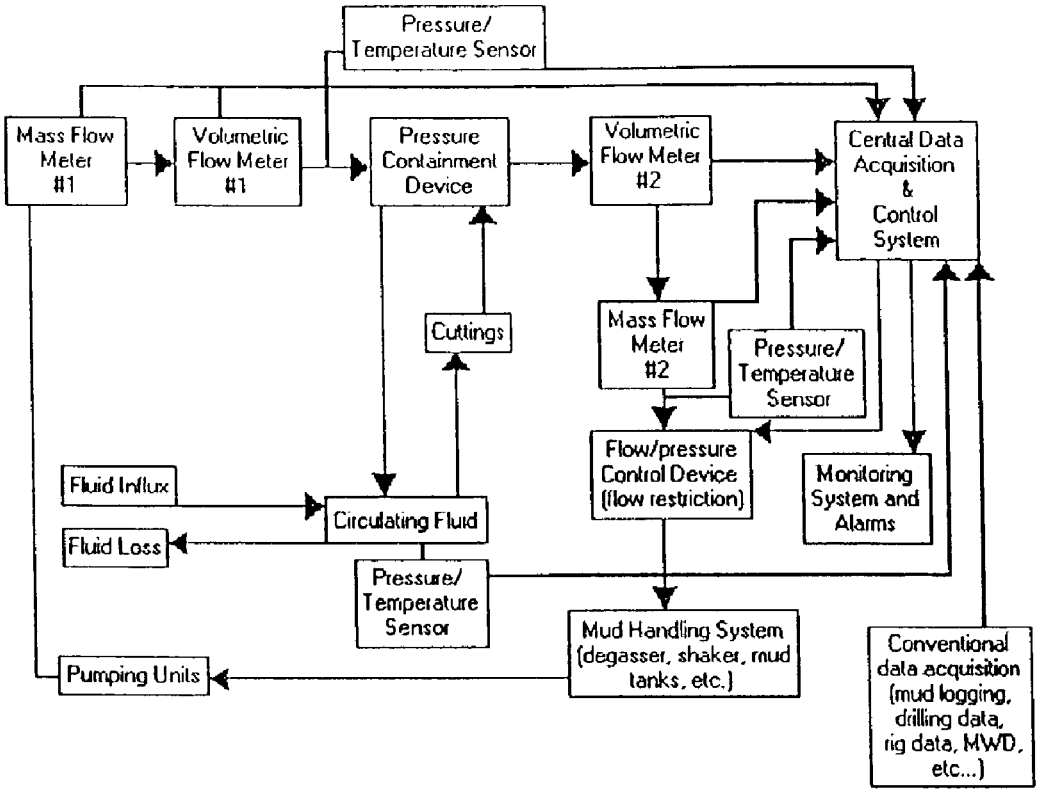

FIG. 7 attached is a general block diagram of the method described in the present invention for the early detection of influx or loss of fluid, direct determination of pore and fracture pressure and regulating ECD instantaneously.

Figure 8:
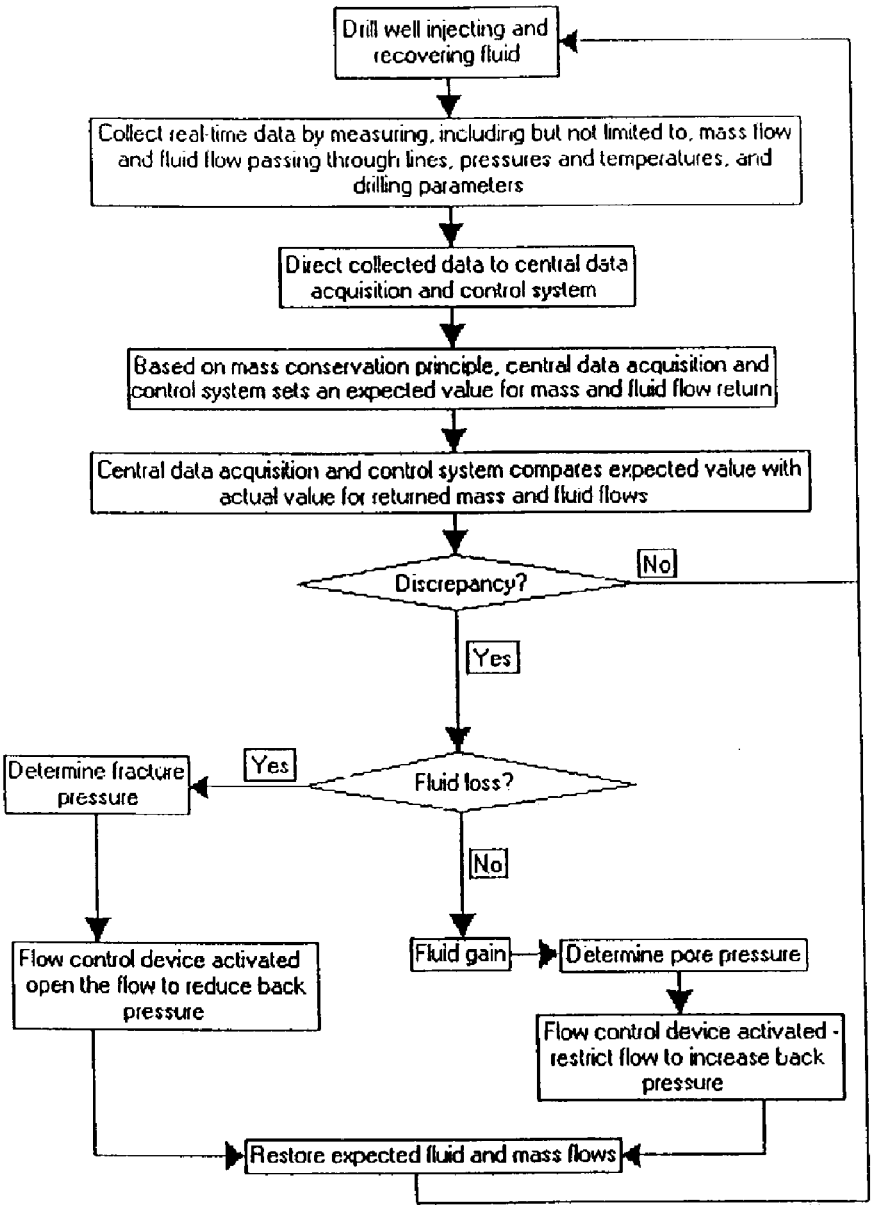

FIG. 8 attached is a flowsheet that schematically illustrates the method of the invention.

As pointed out hereinbefore, the present system and method of drilling wells is based on a closed-loop system. The inventive method and system is applied to oil and gas wells, as well as to geothermal wells.

DETAILED DESCRIPTION OF THE INVENTION

While several of the devices being described have been used in some configuration or combination, and several of the parameter measurements have been included in descriptive methods on patents or literature, none have ever:

1. Simultaneously combined the measurement of all critical parameters to ensure the necessary accuracy required allowing such a system to effectively function as a whole method;
2. Utilized mass flow meters simultaneously on inlet and outlet flows;
3. Utilized mass measurement of cuttings in conjunction with mass flow measurement on inlet and outlet;
4. Utilized a pressure/flow control device as an instant control of ECD during drilling for the purpose of preventing and controlling influx or losses;
5. Defined the use of a pressure/flow control device as a pro-active method for adjusting ECD based on early detection of influx/loss events; or
6. Defined the use of more than one pressure/flow control device combined to a lightweight drilling fluid to make that the equivalent drilling fluid weight above the mud line is lower than the equivalent fluid weight inside the wellbore.

Figure 1:
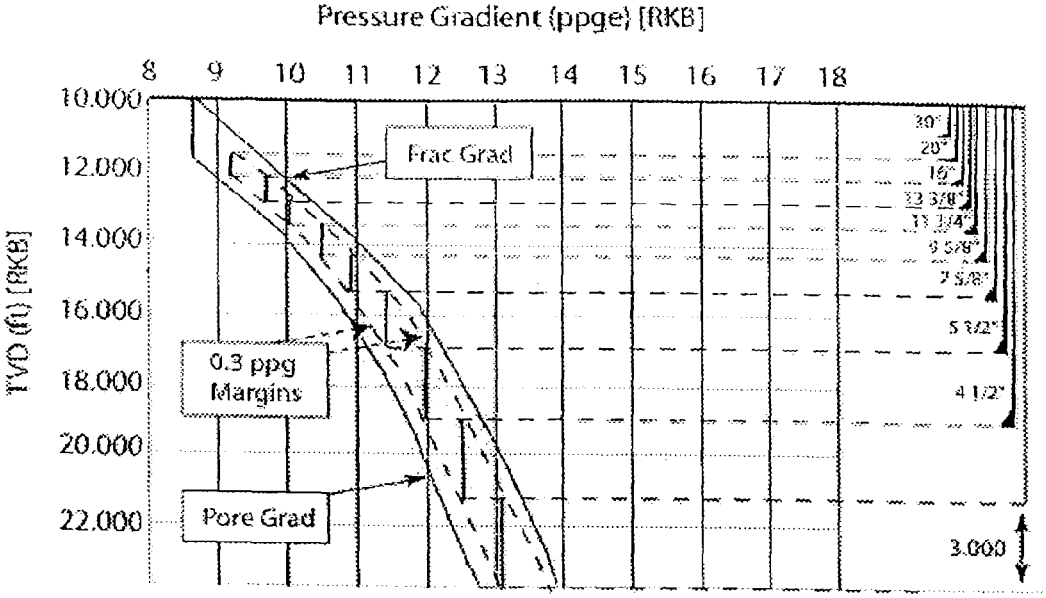
Figure 2:
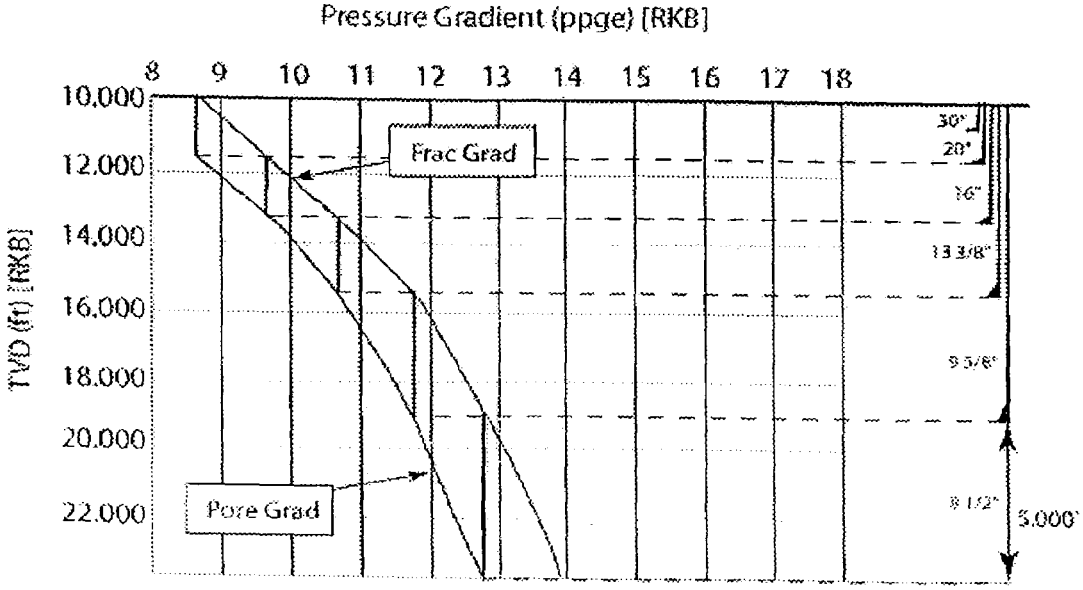
FIG. 2 attached is a log of the same curves according to the invention, without the kick tolerance and tripping margin of 0.3 ppg included. On the right hand side the number of casing strings required can be seen. With the drilling method described in the present application the elimination of the kick tolerance and tripping margin on the design of the well is made possible, since the pore and fracture pressure will be determined in real time while drilling the well, with the well being drilled closed at all times, and, therefore, no safety margin is necessary when designing the well.
Figure 3:
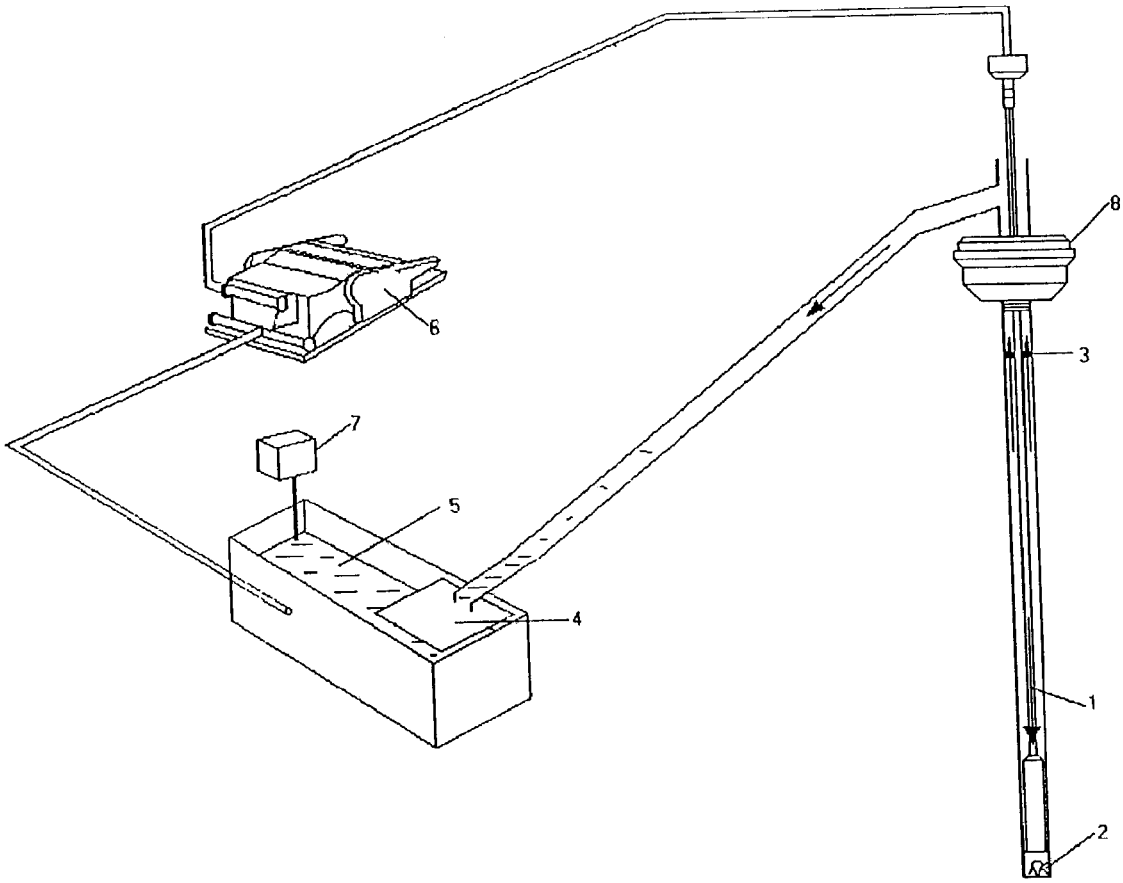
FIG. 3 attached is a prior art schematics of the circulating system of a standard rig, with the return flow open to the atmosphere.

FIG. 3 illustrates a drilling method according to prior art techniques. Thus, a drilling fluid is injected through the drill string (1), down the wellbore through the bit (2) and up the annulus (3). At the surface the fluid that is under atmospheric pressure is directed to the shale shaker (4) for solid/liquid separation. The liquid is directed to the mud tank (5) from where the mud pumps (6) suck the fluid to inject it through the drill string (1) and close the circuit. In case of a kick, normally detected by mud tank volume variation indicated by level sensors (7), the BOP (8) must be closed to allow kick control. At this point the drilling operation is stopped to check pressure and adjust the mud weight to avoid further influxes. Improvements in prior art drilling methods are generally directed to, for example, improve the measurement of volume increase or decrease in tank (5). However, such improvements bring only minor changes to the kick detection procedure; furthermore, no fundamental modifications are known directed to the improvement of safety and/or to keeping the drilling method continuous, this modification being only brought about by the present invention.

Figure 4:
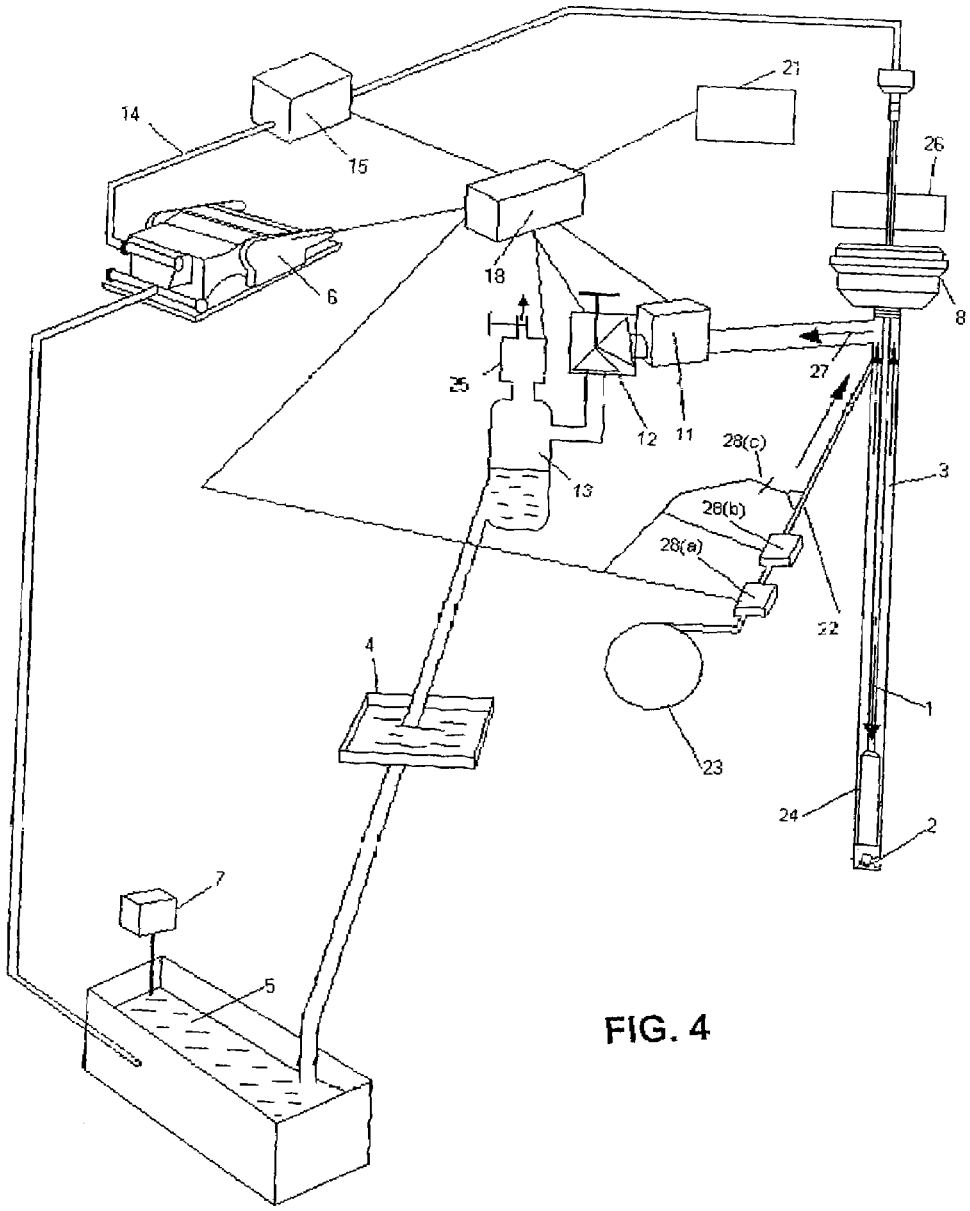
FIGS. 4 to 6 attached are schematics of the circulating system of a rig with the drilling method described in the application. A pressure containment device located at the wellhead, fluid flow meters on the inlet and outlet streams, and other pieces of equipment have been added to the standard drilling rig configuration. Means is illustrated which receives all the data gathered and identifies a fluid influx or loss.

On the contrary, according to FIG. 4 that illustrates the system of the invention, the drilling fluid is injected through the drill string (1), going down towards the bottom hole through the bit (2) and up the annulus (3) and is diverted by a pressure containment device (26) through a closed return line (27) under pressure. BOP (8) remains open during drilling. The fluid is made to contact flow meter (11) and degasser (13) then to the shale shaker (4).

The shale shaker (4) separates the cuttings (drill solids) from the liquid. The mass/volume of gas separated in degasser (13) is measured by a device (25).

The drilling fluid is injected with the aid of pump (6) through an injection line (14) through which said fluid is made to contact flow meter (15). Devices (7), (11), (15) and (25) all acquire data which is directed to a central data point (18) and used to obtain real time values for flow rates, and compared with predicted values and identify any discrepancy. A discrepancy is evaluated initially as any event other than influx or fluid loss which might cause the observed discrepancy and a determination is made whether the discrepancy indicates a malfunctioning or other system event or is an early detection of influx or loss of drilling fluid. This early detection is important to a number of subsequent operations which may be performed in relation to the well, since the detection may be as much as several hours in advance of the consequence of such an influx or loss being apparent at the surface in the form of a kick. Operations include direct determination of pore or fracture pressure, controlling ECD to restore predicted values etc. Safety features present in the system and method include closing BOP (8) thereby closing the well to contain a kick.

An embodiment of the system of FIG. 4 is shown in FIG. 5. In this case the fluid is made to contact pressure and temperature sensors (9), fluid flow meter (10), mass flow meter (11) and flow/pressure control device (12) then degasser (13) and then to the shale shaker (4).

The shale shaker (4) separates the cuttings (drill solids) from the liquid and the solids have their mass/volume determined (19) while the liquid is directed to the mud tank (5) having the mass/volume determined as well (20). All standard drilling parameters are acquired by a device (21) normally called mud logging. Downhole parameters are acquired by a device (24) located close to the bit (2). The mass/volume of gas separated in degasser (13) is measured by a device (25).

The drilling fluid is injected with the aid of pump (6) through an injection line (14) through which said fluid is made to contact mass flow meter (15), fluid flow meter (16), pressure and temperature sensors (17). Devices (7), (9), (10), (11), (15), (16), (17), (19), (20), (21), (24), (25) all acquire data as signals that are directed to a central data acquisition and control system (18). System (18) sends a signal to the pressure/flow control device (12) to open or close it. Whenever it is deemed necessary, a pump (23) may send fluid directly to the annulus (3) through a dedicated injection line (22) via a mass flow meter (28*a*), fluid flow meter (28*b*) and pressure and temperature sensors (28*c*). This injection line may be incorporated as part of the standard circulation system, or embodied in other ways, the purpose being to provide an independent, of normal drilling circulation, means of flow into wellbore. The central data acquisition and control system (18) acquires data from devices (28*a*), (28*b*) and (28*c*).

A further embodiment of the system of FIG. 4 is shown in FIG. 6. In this case it is desired to combine lightweight drilling fluid and back pressures so that the equivalent drilling fluid weight above the mud line is lower than the equivalent fluid weight inside the wellbore. To achieve this, at least two pressure/flow control devices (12) are used. The devices (12) may be placed, one at the bottom of the ocean and the other at the surface, or at any other convenient location. On using a lightweight fluid, it is injected and returned the same way as the conventional fluid, that is, injected through the drillstring and returned through the annulus. In this case more than one dedicated injection line (22) may be used each with a pump (23) to send fluid directly to the annulus (3) through a mass flow meter (28*a*), fluid flow meter (28*b*) and pressure and temperature sensors (28*c*).

According to the concept of the present invention, as illustrated in FIGS. 4 to 6, a pressure containment device (26) diverts the drilling fluid and keeps it under pressure. Device (26) is a rotating BOP and is located at the surface or the sea floor. The drilling fluid is diverted to a closed pipe (27) and then to a surface system. The device (26) is a standard equipment that is commercially available or readily adapted from existing designs.

As described hereinbefore, upon a signal received from control system (18) the pressure/flow control device (12) opens or closes to allow decrease or increase of the back-pressure at the well head so that the outflow can be restored to the predicted value determined by system (18). Two or more of these pressure/flow control devices (12) can be installed in parallel with isolation valves to allow redundant operation. Devices (12) can be positioned downstream of the pressure containment device (26) at any suitable point in the surface system. Some surface systems may incorporate two or more of such devices (12) at different nodes.

One critical aspect of the present method is the accurate measurement of the injected and returned mass and fluid flow rates. The equipment used to carry out such measurement is mass flow meters (11,15) and fluid flow meters (10,16). The equipment is installed in the injected (14) and return (27) fluid lines. These meters may also be installed at the gas outlet (25) of the degasser (13) and somewhere (20) on the fluid line between shale shaker (4) and tank (5). Also they may be installed on the independent injection line (22). The mass and fluid flow meters are commercially available equipment. Multi-phase meters are also commercially available and may be used. The precision of this equipment, allows accurate measurement, subsequent control and safer drilling.

To further improve the accuracy of the method the cuttings mass/volume rate can be measured by commercially available equipment (19) to verify that the mass of cuttings being received back at the surface is correlated with the rate of penetration and wellbore geometry. This data allows correction of the mass flow data and allows identification of trouble events.

The measurements of mass and fluid flow rates provide data that are collected and directed to a central data acquisition and control system (18).

The central data acquisition and control system (18) is provided with a software designed to predict an expected, ideal value for the outflow, said value being based on calculations taking into account several parameters including but not restricted to rate of penetration, rock and drilling fluid density, well diameter, in and out flow rates, cuttings return rate, bottomhole and wellhead pressures and temperatures.

Said software compares the said predicted ideal value with the actual, return flow rate value as measured by the mass flow meters (11,15) and fluid flow meters (10,16). If the comparison yields any discrepancy, the software automatically sends a command to a pressure/flow control device (12) designed to adjust the return flow rate so as to restore the said return flow rate to the predicted, ideal value.

Said software can also receive as input any early detection parameters available or being developed or capable of being developed. Such input will trigger a chain of investigation of probable scenarios, checking of actual other parameter and any other means (databased or software or mathematical) to ascertain that an influx/loss event has occurred. Said software will in such cases preemptively adjust backpressure to immediately control the event.

Said software will allow for override of the standard detection (prior art) by the early detection system of the invention and will compensate and filter for any conflict in fluid/mass flow indication.

Said software may have filters, databases, historical learning and/or any other mathematical methods, fuzzy logic or other software means to optimize control of the system.

The pressure/flow control device (12) used to restore the ideal flow is standard, commercially available equipment or is specifically designed for the required purpose chosen according to the well parameters such as diameter of the return line, pressure and flow requirements.

According to the present method, the flow rates in and out of the wellbore are controlled, and the pressure inside the wellbore is adjusted by the pressure/flow control device (12) installed on the return line (27) or further downstream in the surface system.

Thus, if the drilling fluid volume returning from the wellbore is increasing, after compensating for all possible factors it is a sign that an influx is happening. In this case the surface pressure should be increased to restore the bottomhole pressure in such a way as to overcome the reservoir pressure.

On the other hand, if the fluid volume returning is decreasing, after compensating for all possible factors it means the pressure inside the wellbore is higher than the fracture pressure of the rock, or that the sealing of the drilling mud is not effective. Therefore, it is necessary to reduce the wellbore pressure, and the reduction will take place by lowering the surface back pressure sufficiently to restore the normal condition.

If an early detection signal is confirmed, control system (18) will proactively adjust the backpressure by opening or closing pressure/flow control device (12) to suit the occurred event.

Thus, upon any undesired event, the system acts in order to adjust the rate of return flow and/or pressure thus increasing or decreasing the backpressure, while creating the desired condition downhole of no inflow from the exposed formation or no loss of fluid to the same exposed formation. This is coupled with a feedback loop to constantly monitor the reaction to each action, as well as the necessary software design, and any necessary decision system including but not limited to databases and fuzzy logic filters to ensure consistent operation.

Another very important device used in the method and system of this invention is the pressure containment equipment (26), to keep the well flowing under pressure at all times. By controlling the pressure inside the well with a pressure/flow control device (12) on the return line (27) the bottomhole pressure can be quickly adjusted to the desired value so as to eliminate the losses or gains being detected.

By having a pressure sensor (24) at the bottom of the string (1) and another one (9) at the surface, the pore and fracture pressures of the formations can be directly determined, dramatically improving the accuracy of such pressure values.

The assessment of the pore and fracture pressures according to the method of the invention is carried out in the following way: if the central data acquisition and control system (18) detects any discrepancy and a decision to actuate the pressure/flow control device (12) is made, it is a sign that either a fluid loss or influx is occurring. The Applicant has thus ascertained that if there is a fluid loss this means that the bottomhole pressure being recorded is equivalent to the fracture pressure of the formation.

On the contrary, if an influx is detected, this means that the bottomhole pressure being recorded is equivalent to the pore pressure of the formation.

Further, in case of the absence of the pressure sensor in the bottomhole, the variables pore pressure and fracture pressure can be estimated. Thus, the bottomhole pressure is not one of the variables being recorded and only the wellhead or surface pressure is the pressure variable being acquired. The pore pressure and the fracture pressure can then be indirectly estimated by adding to the obtained value the hydrostatic head and friction losses within the wellbore.

The software pertaining to the central data and control system (18) would include all the necessary algorithms, empirical correlations or other method to allow accurate estimation of the hydrostatic head and friction losses including any transient effects like, but not limited to, changing temperature profile along the wellbore.

A circulation bypass composed of a pump (23) and a dedicated injection line (22) to the wellbore annulus allows keeping a constant pressure downhole during circulation stops and continuously detecting any changes in the mass balance indicative of an influx or loss during the circulation stop.

By using the method and system of the invention, the errors from estimating the required mud weight based on static conditions are avoided since the measurements are effected under the same dynamic conditions as those when the actual events occur.

This method also renders possible to run the mud density at a value slightly lower than that required to balance the formation pressure and using the backpressure on the well to exert an extremely controllable ECD at the bottomhole that has the flexibility to be instantaneously adjusted up or down. This will be the preferred method in wells with very narrow pore pressure/fracture pressure margins as occur in some drilling scenarios.

In this case one of the parameters mentioned in Table 1, which is the advantage of having three safety barriers is negated. However, the current technical limit on some ultra-deep water wells, due to the narrow margin, when drilling with the prior art method, leads to a sequence of fluid influxes/losses due to the inaccuracies in manually controlling the mud density and subsequent ECD as described above, that can lead to loss of control of the drilling situation and has resulted in the abandonment of such wells due to the safety risks and technical inability to recover from the situation.

However, the method of the invention allows, by creating an instant control mud weight window, controlling the ECD by increasing or decreasing the backpressure, controlled by the positioning of the pressure/flow control device, to create the conditions for staying within the narrow margin. This results in the technical ability to drill wells in very adverse conditions as in narrow mud weight window, under full control with the consequent improvement in safety as the well is at all times in a stable circulating condition, while still retaining two barriers i.e. the BOP (blow-out preventer), and the pressure containment device.

The central data acquisition and control system (18) has a direct output for actuation of the pressure/flow control device(s) (12) downstream the wellhead opening or closing the flow out of the well to restore the expected value. At this point, if an action is needed, the bottomhole pressure is recorded and associated to the pore or fracture pressure, if a gain or loss is being observed, respectively.

In case an influx of gas occurs, the circulation of the gas out of the well is immediately effected. By closing the pressure/flow control device (12) to restore the balance of flow and the predicted value, the bottomhole pressure regains a value that avoids any further influx. At this point no more gas will enter the well and the problem is limited to circulating out the small amount of gas that might have entered the well. Since the well that is being drilled is closed at all times, there is no need to stop circulation, check if the well is flowing, shut-in the BOP, measure the pressures, adjust the mud weight, and then circulate the kick out of the well as in standard methods. The mass flow together with the flow rate measurements provide a very efficient and fast way of detecting an inflow of gas. Also, the complete removal of the gas from the well is easily determined by the combination of the mass flow and flow rates in and out of the well.

Also the incorporation of early detection of influx/loss devices, which can pre-emptively result in opening or closing the pressure/flow control device (12), as part of the system, will allow pro-active reaction to influx/losses not achieved by prior art systems.

The function of the rotating pressure containment device (26) is to allow the drill string (1) to pass through it and rotate, if a rotating drilling activity is carried on. Thus, the drill string (1) is stripped through the rotating pressure containment device; the annulus between the outside of the drill pipe and the inside of the wellbore/casing/riser is closed by this equipment. The rotating pressure containment device (26) can be replaced by a simplified pressure containment device such as the stripper(s) (a type of BOP designed to allow continuous passage of non-jointed pipe) on coiled tubing operations. The return flow of drilling fluid is, therefore, diverted to a closed pipe (27) to the surface treatment package. This surface package should be composed of at least a degasser (13) and shale shaker (4) for solids separation. This way the influxes can be automatically handled.

The central data acquisition and control system (18) receives all the signals of different drilling parameters, including but not limited to injection and return flow rates, injection and return mass flow rates, back-pressure at the surface, down-hole pressure, cuttings mass rates, rate of penetration, mud density, rock lithology, and wellbore diameter. It is not necessary to use all these parameters with the drilling method herein proposed.

The central data acquisition and control system (18) processes the signals received and looks for any deviation from expected behavior. If a deviation is detected, the central data acquisition and control system (18) activates the flow pressure/flow control device (12) to adjust the back-pressure on the return line (27). This is coupled with a feedback loop to constantly monitor the reaction to each action, as well as the necessary software design, and any necessary decision system including but not limited to databases and fuzzy logic filters to ensure consistent operation.

In spite of the fact that some early-detection means have been described, it should be understood that the present method and system is not limited to the described items. Thus, an influx may be detected by other means including but not limited to downhole temperature effects, downhole hydrocarbon detection, pressure changes, pressure pulses; said system preemptively adjusting backpressure on the wellbore based on influx or loss indication before surface system detection.

The drilling of the well is done with the rotating pressure containment device (26) closed against the drill string. If a deviation outside the predicted values of the return flow and mass flow rates is observed, the control system (18) sends a signal either to open the flow, reducing the back-pressure or restricting the flow, increasing the back-pressure.

This deviation may also be a signal from an early detection device.

The first option (flow opening) is applied in case a fluid loss is detected and the second one (flow restriction), if a fluid gain is observed. The changes in flow are done in steps previously defined. These step changes can be adjusted as the well is drilled and the effective pore and fracture pressures are determined.

The whole drilling operation is continuously monitored so that a switch to a manual control can be implemented, if anything goes wrong. Any adjustments and modifications can also be implemented as the drilling progresses. If at all desired, restoring to the prior art drilling method is easily done, by not using anymore the rotating pressure containment device (26) against the drill string (1), allowing the annulus to be open to the atmosphere again.

A block diagram of the method described in the present invention is shown in FIG. 7.

In fact, the present system and method implies many variations and modifications within its scope and as such it can be applied to all kinds of wells, onshore as well as offshore, and the equipment location and distribution can vary according to the well, risks, application and restrictions of each case.

EXAMPLES

The invention is now illustrated in non-limiting manner with reference to the following Examples and FIGURES

Example 1

Identifying and Controlling Influx or Fluid Loss

Usually, in the prior art methods and systems indirect estimation made before drilling, based on correlations from logs, or during drilling using drilling parameters are the best alternatives to determine the pore pressure. Similarly, fracture pressure is also indirectly estimated from logs before drilling. In some situations the fracture pressure is determined at certain points while drilling, usually when a casing shoe is set, not along the whole well.

Advantageously, when using the method and system of the invention the pore and fracture pressure may be directly determined while drilling the well. This entails great savings as regards safety and time, two parameters of utmost importance in drilling operations.

In prior art methods, the bottomhole pressure is adjusted by increasing or reducing the mud weight. The increase or reduction in mud weight is most of the time effected based on quasi-empirical methods, which by definition implies inaccuracies, which are handled by an iterative process of:—adjusting mud weight, measuring mud weight—this process being repeated until the desired value is reached. To further complicate the matter, due to the time lag, caused by the circulation time (i.e., time for a full loop movement of a unit element of mud), the adjustments must be made in stages, e.g., in order to quickly contain an influx, a higher density mud is introduced into the system to produce an increase in ECD (Equivalent Circulating Density). At the point where additional hydrostatic head of this higher density mud, coupled with the hydrostatic head of lower density mud, initially in circulation, becomes close to being sufficient to contain the influx, another variation in density of mud must be executed in order not to increase the ECD to the point of creating losses. This is further complicated by the fact that such density adjustments affect the rheology (viscosity, yield point, etc.) of the mud system leading to changes in the friction component, which in turn has a direct effect on the ECD. So, in practice, the adjustment of mud weight is not always successful in restoring the desired equilibrium of fluid circulation in the system. Inaccuracy, depending on its extent, may lead to hazardous situations such as blowouts.

On the contrary, the method and system of the invention allows for a precise adjustment of increase or reduction in bottomhole pressure. By using the pressure/flow control device (12) to restore the equilibrium and pressures inside the wellbore, the adjustment is much faster achieved, avoiding the hazardous situation of well-known methods.

Also, by using more than two pressure/flow control devices and a lightweight drilling fluid, it is possible to make that the equivalent drilling fluid weight above the mud line may be set lower than the equivalent fluid weight inside the wellbore, this creating a dual-density gradient, which in some situations is absolutely necessary to accomplish the objectives of the well.

It should also be pointed out that in prior art methods the required bottomhole pressures needed to restore the equilibrium are estimated under static conditions, since these determinations are made without fluid circulation. However, the influxes or fluid losses are events that occur under dynamic conditions. This implies in even more errors and inaccuracies.

FIG. 8 is a flowchart illustrating the drilling method of the invention in a schematic mode, with the decision-making process that identifies an influx or loss and/or leads to the restoration of the predicted flow as determined by the central data acquisition and control system. A further decision making loop is incorporated at "discrepancy" and applies scenarios to the observed discrepancy, such as sensor malfunction, fluid loss to the shaker with formation changes, ECD gain, fluid addition rate exceeding the programmed rate for a predicted fluid flow and the like. If the discrepancy is found to be caused by such a scenario, the system generates a sensor alert, or restores a malfunctioning or malcontrolled parameter or resets predicted values to the deviant parameter. If the discrepancy is found not to be caused by such a scenario, it is identified as an influx or fluid loss.

A further decision making loop is then incorporated at "fluid loss" and "fluid gain" and applies loss or gain events to the observed discrepancy to identify the nature of fluid, whereupon by applying the principle of mass conservation, the influx or loss can be fully characterised by amount and location(s), and change in backpressure calculated to contain the influx or loss event.

Table A shows such a decision making process applied after identifying an influx or fluid loss, either by conventional method such as downhole temperature effects, hydrocarbon detection, change in pressure, pressure pulse and the like, or by the method of the invention comparing predicted and actual flow out.

TABLE A

| Discrepancy | Event | Regulate fluid out value and recompare - discrepancy remains? |
|---|---|---|
| increase in fluid out | fluid is gas, expands | yes - go back to Event |

TABLE A-continued

| Discrepancy | Event | Regulate fluid out value and recompare - discrepancy remains? |
|---|---|---|
| | fluid is water, no expansion | yes - go back to Event |
| | fluid is oil, gas is soluble in oil | no - event identified, calculate required backpressure |

A plot of predicted ECD with time against actual ECD with time would show a discrepancy of predicted and actual at a time point A (influx event analysis), which is then contained at a time point B and circulated out at a time point C. Containment of influx occurs after influx event analysis to identify nature of fluid, whereupon location and amount of influx is determined. In the case of a soluble fluid influx, the actual ECD would show an influx increase as it rises up the well, and circulation out is only complete as the solubility is identified in a second influx event analysis at time point D. A control loop continuously checks predicted and actual ECD values and revises adjustment required to restore the predicted ECD, or in the case of a change in formation or the like, sets a new predicted ECD. It will therefore be apparent that in some cases the influx or loss is contained and new ECD levels are set. In some cases the discrepancy is not in fact an influx or loss but is a change in formation whereby the predicted values are not effective and a parameter relating to the well has changed, and revision of predicted values is necessary.

Example 2

Comparison with Conventional Methods

It has been mentioned before that in the conventional drilling methods the hydrostatic pressure exerted by the mud column is responsible for keeping the reservoir fluids from flowing into the well. This is called a primary safety barrier. All drilling operations should have two safety barriers, the second one usually being the blow-out preventer equipment, which can be closed in case an influx occurs. The drilling method and system herein described introduces for the first time three safety barriers during drilling, these being the drilling fluid, the blow-out preventer equipment, and the rotating pressure containment device.

In underbalanced drilling (UBD) operations, there are just two barriers, the rotating pressure containment device and the blow-out preventer, since the drilling fluid inside the wellbore must exert a bottomhole pressure smaller than the reservoir pressure to allow production while drilling.

As noted before, there are three other main methods of closed system drilling, known as underbalanced drilling (UBD), mud-cap drilling, and air drilling. All three methods have restricted operating scenarios applicable to small portions of the wellbore, with mud-cap drilling and air drilling only usable under very specific conditions, whereas the method herein described is applicable to the entire length of the wellbore.

TABLE 1 below shows the key differences among the traditional drilling system (Conv.), compared with the underbalanced drilling system (UBD) and the present drilling method herein proposed. It can be seen that the key points addressed by the present application are not covered or considered by either the traditional conventional drilling system or by the underbalanced drilling method currently used by the industry.

TABLE 1

| Feature | UBD | Conv. | INVENTION |
|---|---|---|---|
| Well closed at all times | Yes | No | Yes |
| Production of reservoir fluids while drilling | Yes | No | No |
| Flow rates measured in and out | Yes | Yes | Yes |
| Mass flow measured in | No | No | Yes |
| Mass flow measured out | Yes | No | Yes |
| Prediction of expected outflow | No | No | Yes |
| Pressure/flow control device on the return line | Yes | No | Yes |
| Return flow adjusted automatically according to mass balance | No | No | Yes |
| Degasser device on the return line | Yes | No | Yes |
| Kick detection accurate and fast | N/A | No | Yes |
| Real time[1] kick/loss detection while drilling | No | No | Yes |
| Can instantly utilize input from early detection of kick/loss | N/A | No | Yes |
| Bottom-hole pressure instantly[2] adjusted from surface with small action | No | No | Yes |
| Three safety barriers while drilling | No | No | Yes |
| Accurate pore and fracture pressure determination while drilling | No | No | Yes |
| Can keep a constant pressure at bottom hole during connections and trips | No | No | Yes |
| Immediate control of the well in case of kick | N/A | No | Yes |
| Can be used to drill the entire well | No | Yes | Yes |
| Can be used to drill safely within a very narrow pore/fracture pressure margin | No | No | Yes |

Where N/A = not applicable
[1]real time is the determination of the pore and fracture pressure at the moment the influx of fluid loss occurs, rather than by means of calculation after some period of time.
[2]the underbalanced drilling case here considers a two-phase flow, the most common application of this type of drilling system.

The present method is applicable to the whole wellbore from the first casing string with a BOP connection, and to any type of well (gas, oil or geothermal), and to any environment (land, offshore, deep offshore, ultra-deep offshore). It can be implemented and adopted to any rig or drilling installation that uses the conventional method with very few exceptions and limitations.

Further, the proposed closed-loop drilling method combined with the injection of lightweight fluids to produce dual-density gradient drilling is distinguished from the prior art mud-lift systems by the features listed in TABLE 2 below.

TABLE 2

| FEATURE | INVENTION | DUAL DENSITY PRIOR ART |
|---|---|---|
| Equipment location | Surface except RBOP and choke | Mud Line |
| Operational procedures | Simple | Complex |
| Well control | Standard | Totally new |
| Failure potential | Low | High |
| Time/Conditions to repair | Quick and cheap | Very expensive |
| Restore to conventional drilling Method | Easy and Immediate | Not simple |

It should be understood that the mode of the invention using conventional drilling fluid and at least two pressure/flow control devices to apply back pressure is equally able to generate dual density gradient effect. However, this will be useful only to specific pressure profiles, not contemplating deepwater locations where the fracture gradients are low.

Thus the present method can be called INTELLIGENT SAFE DRILLING, since the response to influx or losses is nearly immediate and so smoothly done that the drilling can go on without any break in the normal course of action, this representing an unusual and unknown feature in the technique.

Therefore, the present system and method of drilling makes possible:

i) accurate and fast determination of any difference between the in and out flow, detecting any fluid losses or influx;
ii) easy and fast control of the influx or losses;
iii) strong increase of drilling operations safety in challenging environments, such as when drilling in narrow margin between pore and fracture pressures;
iv) strong increase of drilling operations safety when drilling in locations with pore pressure uncertainty, such as exploration wells;
v) strong increase of drilling operations safety when drilling in locations with high pore pressure;
vi) easy switch to underbalanced or conventional drilling modes;
vii) drilling with minimum overbalance, increasing the productivity of the wells, increasing the rate of penetration and thus reducing the overall drilling time;
viii) direct determination of both the pore and fracture pressures;
ix) a large reduction in time and therefore cost spent weighting (increasing density) and cutting back (decreasing density) mud systems;
x) a large reduction in the cost of wells by reduction in the number of necessary casing strings;
xi) a significant reduction in the cost of wells by significantly reducing or eliminating completely the time spent on the problems of differential sticking, lost circulation;
xii) significantly reducing the risk of underground blowouts;
xiii) a significant reduction of risk to personnel compared to conventional drilling due to the fact that the wellbore is closed at all times, e.g., exposure to sour gas;
xiv) a significant cost reduction due to lowering quantities of mud lost to formations;
xv) a significant improvement in productivity of producing horizons by reduction of fluid loss and consequential permeability reduction (damage);
xvi) a significant improvement in exploration success as fluid invasion due to overweighted mud is limited. Such fluid invasion can mask the presence of hydrocarbons during evaluation by electric logs;
xv) to drill wells in ultra deep water that are reaching technical limit with conventional prior art method;
xvi) to economically drill ultra-deep wells onshore and offshore by increasing the reach of casing strings.

Example 3

Design of Modules

For a well determining number and location of pressure/flow control devices (chokes) required and required operating pressure range. Skid comprising eg 3 parallel injection lines each having sensors, and a common degasser is designed for eg 5000 psi in 3 chokes, or greater pressure tolerance in 10 chokes etc. Skid can be simply installed in any conventional system. A further skid may comprise one or more chokes with a bypass for adjustment. A further skid may comprise a dedicated circulating system for injection direct into the annulus

The invention claimed is:

1. System for operating a well that is being drilled with a drill string to provide a wellbore having a drilling fluid circulated therethrough via inlet and outlet streams, wherein the well is kept closed at all times, wherein the system comprises:

a) a pressure containment device to the wellbore which keeps the wellbore closed at all times while it is being drilled;

b) means for measuring at least one of mass flow, volumetric flow, mass flow rate and volumetric flow rate on the inlet and outlet streams and generating flow signals, wherein monitoring means are located on lines in and out and are operated continuously throughout a given operation;

c) at least one pressure sensor to obtain pressure signals, wherein the at least one pressure monitoring sensor is located at the wellhead or at the bottomhole and is operated continuously throughout a given operation;

d) a central data acquisition and control system provided with software for predicting a real time signal;

e) means for injecting drilling fluid through an injection line through which said fluid is made to contact said flowmeans, and said pressure sensor, and recovering drilling fluid through a return line;

f) means for collecting drill cuttings at the surface;

g) means for collecting flow signals;

h) means for collecting pressure signals;

i) means for directing all the collected signals to the said central data acquisition and control system;

the software of the central data acquisition and control system considering, at each time, a real time predicted signal;

the system further comprising j) a pressure or flow control device on the outlet stream to control the flow out of the well and to keep a back pressure on the well; and k) means to send a command from the central data acquisition and control system to the pressure or flow control device designed to adjust the volumetric or mass flow rate in the return line or pressure inside the wellbore; and the central data acquisition and control unit being programmed to compare said real time predicted signal to the signal;

wherein the system acts on the principle of volume or mass conservation to determine the difference in volume or mass being injected and returned from the well; said determining compensates for factors including increase in hole volume, additional mass of rock returning as an indication of the nature of the fluid event occurring downhole;

said comparison yielding any said discrepancy, said software also receiving as input any early detection parameters, wherein the input triggers a chain of investigation of probable scenarios, to ascertain that an influx or loss event has occurred;

and converting said discrepancy to a value for adjusting the pressure or flow control device and restoring the predicted signal, wherein the software on identifying the influx or loss event, automatically sends a command to the pressure or flow control device designed to adjust the return flow rate or pressure inside the wellbore so as to restore the said signal to the predicted signal, thereby preemptively adjusting backpressure to immediately control the event without interruption of the drilling operation and wherein the system is a closed loop system, whereby monitoring means continuously provide date to the central data acquisition and control system whereby a predicted signal is continuously revised in response to any adjustment of actual signal value, adjusting ECD wherein the system further comprises a means for controlling equivalent circulating density which is defined as hydrostatic pressure plus friction losses occurring while circulating fluid converted to equivalent mud density at the bottom of the well, and continuously or intermittently drilling a gas, oil or geothermal well wherein drilling is carried out using bottom hole pressure chosen from one of the group comprising of: being a value intermediate the pore pressure and the fracture pressure of the well and able to directly determine either or both values if desired; being the exact bottom hole pressure needed, with a direct determination of the pore pressure; or being bottom hole pressure regulated to be just less than the pore pressure (known as underbalanced drilling) thus generating a controlled influx which may be momentary in order to sample the well fluid in controlled manner or may be continuous in order to produce well fluid in controlled manner.

2. System as claimed in claim 1 comprising at least one pump and a dedicated fluid injection line for injecting fluid direct to an annulus for the purpose of pressuring the wellbore through the annulus, independently of the current fluid injection path, and monitoring flow, pressure and optionally temperature the annulus provided between the drill string and the wellbore or a zone thereof, together with dedicated flow meters and additional means such as pressure or flow control devices, pressure or temperature sensors and the like.

3. System as claimed in claim 1 wherein the at least one pressure sensor is located at the surface or at the bottom hole.

4. System as claimed in claim 1 comprising two or more pressure containment devices in series throughout the well bore whereby a pressure profile may be established throughout the well and two or more pressure or flow control devices in series or parallel.

5. System as claimed in claim 1 comprising more than two pressure or flow control devices in series whereby a pressure profile is established in independent pressure zones created throughout the length of the well, wherein restrictions or pressure or flow control devices define the interfaces of each zone.

6. System as claimed in claim 1 wherein the drilling fluid is selected from at least one of oil and water liquid phase fluids and a combination with gas phase fluids or lightweight fluid.

7. System as claimed in claim 1 comprising means for monitoring values for rate of penetration, rock and drilling fluid density, well diameter, in and out flow rates, cuttings return rate, bottomhole and surface pressures and temperatures, torque and drag and basing calculations taking into account these and others for predicting ideal signal value.

8. System as claimed in claim 1 wherein the said central data acquisition and control system is provided with a time-based software to allow for lag time between in and out flux.

9. System as claimed in claim 8 wherein said software is provided with detection filters or processing filters to eliminate or reduce false indications on the received signals, and any other measured or detected parameters.

10. System as claimed in claim 1 which comprise three safety barriers, the drilling fluid, a blow-out preventer equipment and the pressure containment device.

11. Method for constructing a system as claimed in claim 1 said method comprising the steps of:

a) providing a pressure containment device to the wellbore;

b) providing means for measuring and monitoring at least one of volumetric flow, mass flow, volumetric flow rate and mass flow rate an the inlet and outlet streams and obtaining flow or flow rate signals, wherein monitoring means are located on lines in and out and are operated continuously throughout a given operation;

c) providing at least one pressure sensor to obtain and monitor pressure signals, wherein the at least one pressure monitoring sensor is located at the wellhead or at the bottomhole and is operated continuously throughout a given operation;

d) providing a central data acquisition and control system provided with software for predicting a real time signal;

e) providing means for injecting drilling fluid through an injection line through which said fluid is made to contact said flow means, and said pressure sensor, and recovering drilling fluid through a return line;

f) providing means for collecting drill cuttings at the surface;

g) providing means for collecting flow signals;

h) providing means for collecting pressure signals;

i) providing means for directing all the collected signals to said central data acquisition and control system;

j) the software of the central data acquisition and control system considering, at each time, a predicted signal;

the method further comprising k) providing a pressure or flow control device on the outlet stream to control the flow out of the well and to keep a back pressure on the well;

l) providing means to send a command from the central data acquisition and control system to the pressure or flow control device designed to adjust the fluid or mass flow rate in the return line or pressure inside the wellbore;

and the central data acquisition and control unit being programmed to compare a real time predicted signal to the corresponding actual signal;

wherein the system acts on the principle of mass or volume conservation, to determine the difference in mass or volume being injected and returned from the well; said determining compensates for factors including increase in hole volume, additional mass of rock returning as an indication of the nature of the fluid event occurring downhole;

said comparison yielding any said discrepancy, said software also receiving as input any early detection parameters, wherein the input triggers a chain of investigation of probable scenarios, to ascertain that an influx or event has occurred;

and convening said discrepancy to a value far adjusting the pressure or flow control device and restoring the predicted signal value, wherein the software on identifying the influx or loss event, automatically sends a command to the pressure or flow control device designed to adjust the flow rate in the return line or pressure inside the wellbore so as to restore the said flow rate in the return line or pressure inside the wellbore to the predicted ideal signal value, thereby preemptively adjusting backpressure to control the event without interrupting the drilling operation and wherein the system is a closed loop system, whereby monitoring means continuously provide data to the central data acquisition and control system whereby a predicted signal is continuously revised in response to any adjustment of actual signal value, adjusting ECD.

12. Method for constructing a system as claimed in claim 11 comprising at least one temperature sensor to measure temperature, wherein the method comprises additionally in step h) providing means for collecting temperature signals, and in step i) providing means for directing temperature signals to the central data acquisition and control system wherein the method additionally compensates for compressibility changes as an indication of the fluid event occurring downhole.

13. Method as claimed in claim 11 wherein a predicted and actual signal is at least one of predicted and actual flow out of the well, and predicted and actual pressure in the well, and predicted and actual ECD.

14. Injection line of a system according to claim 1 comprising a pump and sensors for fluid flow, and means for sealingly engaging with the well for injection into an annulus for the purpose of pressuring the wellbore through the annulus, independently of the current fluid injection path, and monitoring flow, pressure and optionally temperature, the annulus provided between the drillstring and the wellbore.

15. System as claimed in claim 1 wherein a predicted and actual signal is at least one of predicted and actual flow out of the well, and predicted and actual pressure in the well, and predicted and actual ECD.

16. Return line of a system for operating a well that is being drilled with a drill string to provide a wellbore having a drilling fluid circulated therethrough via inlet and outlet streams, wherein the well is kept closed at all times, wherein the system comprises:

a) a pressure containment device to the wellbore;

b) means for measuring at least one of mass flow, volumetric flow, mass flow rate and volumetric flaw rate on the inlet and outlet streams and generating flow signals;

c) at least one pressure sensor to obtain pressure signals;

d) a central data acquisition and control system provided with software for predicting a real time signal;

e) means for injecting drilling fluid through an injection line through which said fluid is made to contact said flowmeans, and said pressure sensor, and recovering drilling fluid through a return line;

f) means for collecting drill cuttings at the surface;

g) means for collecting flow signals;

h) means for collecting pressure signals;

i) means for directing all the collected signals of different drilling parameters to the said central data acquisition and control system;

the software of the central data acquisition and control system considering, at each time, a real time predicted signal;

the system further comprising j) a pressure or flow control device on the outlet stream to control the flow out of the well and to keep a back pressure on the well; and k) means to send a command from the central data acquisition and control system to the pressure or flow control device designed to adjust the volumetric or mass flow rate in the return line or pressure inside the wellbore; and the central data acquisition and control unit being programmed to compare said real time predicted signal to the signal;

wherein the system acts on the principle of volume or mass conservation to determine the difference in volume or mass being injected and returned from the well; said determining compensates for factors including increase in hole volume, additional mass of rock returning as an indication of the nature of the fluid event occurring downhole;

said comparison yielding any said discrepancy, said software also receiving as input any early detection parameters, wherein the input triggers a chain of investigation of probable scenarios, to ascertain that an influx or loss event has occurred;

and converting said discrepancy to a value for adjusting the pressure or flow control device and restoring the predicted signal, wherein the software on identifying the influx or loss event, automatically sends a command to the pressure or flow control device designed to adjust the return flow rate or pressure inside the wellbore so as to restore the said signal to the predicted signal, thereby preemptively adjusting backpressure to immediately control the event and wherein the system is a closed loop system, whereby monitoring means continuously provide data to the central data acquisition and control system whereby a predicted signal is continuously revised in response to any adjustment of actual signal value, adjusting ECD the return line comprising one or more return line segments in parallel each comprising a pressure or flow control device and sensors for flow out.

17. A return line as claimed in claim 16 comprising a degasser which is suited for insertion in the return line to operate in a desired pressure range.

18. A return line as claimed in claim 16 for location at the ground surface or at the seabed.

* * * * *